United States Patent [19]

Stone et al.

[11] Patent Number: 4,735,266

[45] Date of Patent: Apr. 5, 1988

[54] METHOD AND APPARATUS FOR ISOLATING A PLURALITY OF VERTICALLY SPACED PERFORATIONS IN A WELL CONDUIT

[75] Inventors: Patrick C. Stone, Houston; Mike A. Luke, Pasadena; Gary D. Ingram, Sugarland, all of Tex.

[73] Assignee: Baker Oil Tools, Inc., Orange, Calif.

[21] Appl. No.: 922,355

[22] Filed: Oct. 23, 1986

[51] Int. Cl.[4] ..... E21B 33/124

[52] U.S. Cl. ..... 166/313; 166/115; 166/191; 166/196; 166/387

[58] Field of Search ..... 166/134, 138–140, 166/387, 127, 182, 186, 191, 196, 119, 115, 147, 313

[56] References Cited

U.S. PATENT DOCUMENTS

| | | | |
|---|---|---|---|
| 2,107,655 | 2/1938 | Vogt et al. | 166/127 |
| 2,621,743 | 12/1952 | Johnston | 166/186 |
| 2,675,876 | 4/1954 | Conrad et al. | 166/140 |
| 2,715,441 | 8/1955 | Bouvier | 166/138 |
| 2,760,580 | 8/1956 | Johnston | 166/191 |
| 3,012,611 | 12/1961 | Haines | 166/191 |
| 3,097,698 | 7/1963 | Corley, Jr. et al. | 166/147 |

*Primary Examiner*—James A. Leppink
*Assistant Examiner*—Huang C. Dang
*Attorney, Agent, or Firm*—Norvell & Associates

[57] ABSTRACT

A plurality of packing elements are mounted in vertically spaced relationship on a tubing string with the spacing of the elements corresponding generally to the spacing of a plurality of sets of perforations in a well conduit. The lowermost packing unit is provided with radially expanding locking elements which engage a locking groove provided in the well conduit. All packing units incorporate expandable elastomeric sealing members and are set by the application of tension to the tubing string and are unset by the subsequent application of a higher degree of tension to the tubing string.

12 Claims, 14 Drawing Sheets

METHOD AND APPARATUS FOR ISOLATING A PLURALITY OF VERTICALLY SPACED PERFORATIONS IN A WELL CONDUIT

BACKGROUND OF THE INVENTION

FIELD OF THE INVENTION

The invention relates to a method and apparatus for isolating a plurality of vertically spaced sets of perforations provided in a well conduit adjacent production formations to permit the concurrent treatment of such formations with predetermined amounts of a treatment fluid, either liquid or gas. In many oil and gas wells, the well conduit may traverse a plurality of vertically spaced production formations or zones. The well conduit is generally perforated to provide communication with each of the production zones. If the need arises for chemical treatment of the production zones, it is highly desirable that each of the set of perforations be isolated from each other so that treatment may be selectively applied to only one or more of the production zones. Similarly, in many oil and gas fields, a plurality of wells located in close proximity to each other traverse common production formations. When the initial production from such wells reach an unacceptably low level, it has been a common practice to perform secondary recovery operations on the wells. The secondary operation comprises taking a centrally located one of a group of wells and applying either water or carbon dioxide to the production zones traversed by such well. Such water or gas flooding drives the hydrocarbons in the production formation towards the remaining active wells and enhances their productivity. In both recovery operations, it is highly desirable that the supplied fluid be confined to the production zones and thus be capable of substantial recovery from the producing wells. This is particularly important in recovery operations where pressurized carbon dioxide is utilized. Here again, the necessity arises for effectively isolating each set of a plurality of vertically spaced sets of perforations in the well conduit carrying the treatment fluid from the adjoining sets of perforations.

The prior art has not provided a simple, inexpensive method and apparatus for isolating a plurality of sets of perforations in a well conduit from each other so as to permit the selective application of predetermined amounts of treatment or flooding fluid concurrently to each of the sets of perforations.

SUMMARY OF THE INVENTION

The method and apparatus of this invention may be applied to a new well built for the purpose of supplying treatment fluid to production zones traversed by the well or to previously completed wells, including wells completed by the openhole method referred to technical paper SPE 15009, copyrighted in 1981 by the Society of Petroleum Engineers. In the case of a new well, a steel liner is conventionally suspended from the bottom end of a casing to traverse the various production zones for which fluid treatment is desired. The liner is then cemented in place and perforated in the vicinity of each of the production zones by conventional methods, thus providing a plurality of vertically spaced sets of perforations respectively communicating only with the production zones. In the case of a previously completed well, the well is filled with a permeable sand-resin mixture and then redrilled to permit a new liner to be inserted therein, traversing the various production zones for which treatment is desired. The liner is cemented in the new hole and perforated by conventional methods. To minimize cost, a relatively small-diameter liner is employed having an ID on the order of 2.5 inches. With such a small diameter liner, it is possible to utilize threadably connected tubular sections fabricated from a fiberglass-reinforced plastic. The employment of such reinforced plastic as a liner material substantially increases the life of the liner because of its greater resistance to the acid environment created by the injection of carbon dioxide, but it is not possible to utilize conventional packers within the bore of the fiberglass liner due to the damage to the bore walls which would be inflicted through the employment of conventional slips.

In accordance with this invention, at least one metallic section is incorporated in the fiberglass sections, preferably near the bottom of the threadably interconnected fiberglass sections, and such metallic section defines an internal annular locking groove which receives a plurality of radially expandable locking dogs carried by a tension set packer inserted in the bore of the fiberglass liner on a tubular assembly which is run into the well on a tubular work string.

The tubular assembly is provided with a plurality of vertically spaced, radial ports which are respectively alignable with the various sets of perforations provided in the liner, with the exception of the lowermost set of perforations for which no radial port is required. In addition to the packer carried by the tubular assembly, a plurality of vertically spaced, tension set packing units are mounted on the tubular assembly and are expandable into sealing engagement with the bore of the liner by manipulation of the tubing string, thus providing an annulus seal intermediate each of the sets of perforations to isolate each set of perforations from the adjacent set.

Adjacent each radial port in the tubular assembly, a flow dividing, adjustable valve is removably mounted. Such valve carries axially spaced seals which are disposed in straddling relationship to the adjacent radial port. The valve divides the fluid flow coming down the bore of the tubular member into a radial and an axial component, with the amount of flow going into the radial component being adjustable. Thus, when a treatment fluid, either water or $CO_2$, is supplied through the tubing string, a preselected proportion of the treatment fluid will be diverted from the main axial flow by each of the flow-dividing valves and the selected proportion will be directed into the adjacent production formation by flowing through the radial port and through the adjacent set of perforations. The remaining treatment fluid in the bore of the tubular member reaching the bottom of such tubular member can flow directly into the lowermost set of perforations by flowing out of the open bottom end of the tubular assembly.

If the well casing is of a size to permit the insertion therein of a side pocket mandrel, then in a modification of this invention, a side pocket mandrel may be employed at the upper end of the tubular assembly. An adjustable orifice valve is mounted in the side pocket of the side pocket mandrel and a fluid conduit is provided connecting the bottom end of the side pocket with the exterior of the tubular assembly. Thus, a predetermined proportion of the axially flowing treatment fluid entering the bore of the tubular assembly may be diverted through the orifice valve mounted in the side pocket mandrel to flow directly into the uppermost set of perforations provided in the tubular liner. The tubular liners employed are, as mentioned above, of such small diameter as to not accommodate side pocket mandrels and hence the internally mounted, adjustable flow-dividing valves are employed to effect the diversion of a predetermined amount of the axially flowing treatment fluid into each of the vertically spaced sets of perforations, hence into each of the vertically spaced production zones.

Thus, by adjustment of the flow-dividing valves, and the orifice valve, if used, which are readily wireline removable and insertable, a desired flow rate of the treatment fluid into each of the production zones may be obtained and such desired flow rates concurrently respectively applied to each of the production zones. No treatment fluid is lost by penetration into porous strata between the production zones due to the cementing of the liner in the bore hole. Thus, by adjustment of the flow dividing valves, which are readily wireline removable and insertable, a desired flow rate of the treatment fluid into each of the isolated production zones may be obtained and such desired flow rates concurrently respectively apply to each of the production zones. No treatment fluid is lost by penetration into the porous strata between the production zone due to the cementing of the liner in the bore hole. It follows that a substantial improvement in the amount of treatment fluid recovered from adjacent producing wells will be inherently realized.

The method and apparatus of this invention is equally applicable to a conventional well to effect the isolation of a plurality of sets of perforations provided in a well conduit from each other for any purpose, and the herein described utilization of the method and apparatus of this invention for controlling the application of flooding fluids through a iberglass liner to a plurality of production zones represents only one potential application of this invention.

Further advantages of the invention will be readily apparent to those skilled in the art from the following detailed description, taken in conjunction with the annexed sheets of drawings, on which is shown several embodiments of the invention.

DESCRIPTION OF PREFERRED EMBODIMENTS

Figure 1A:
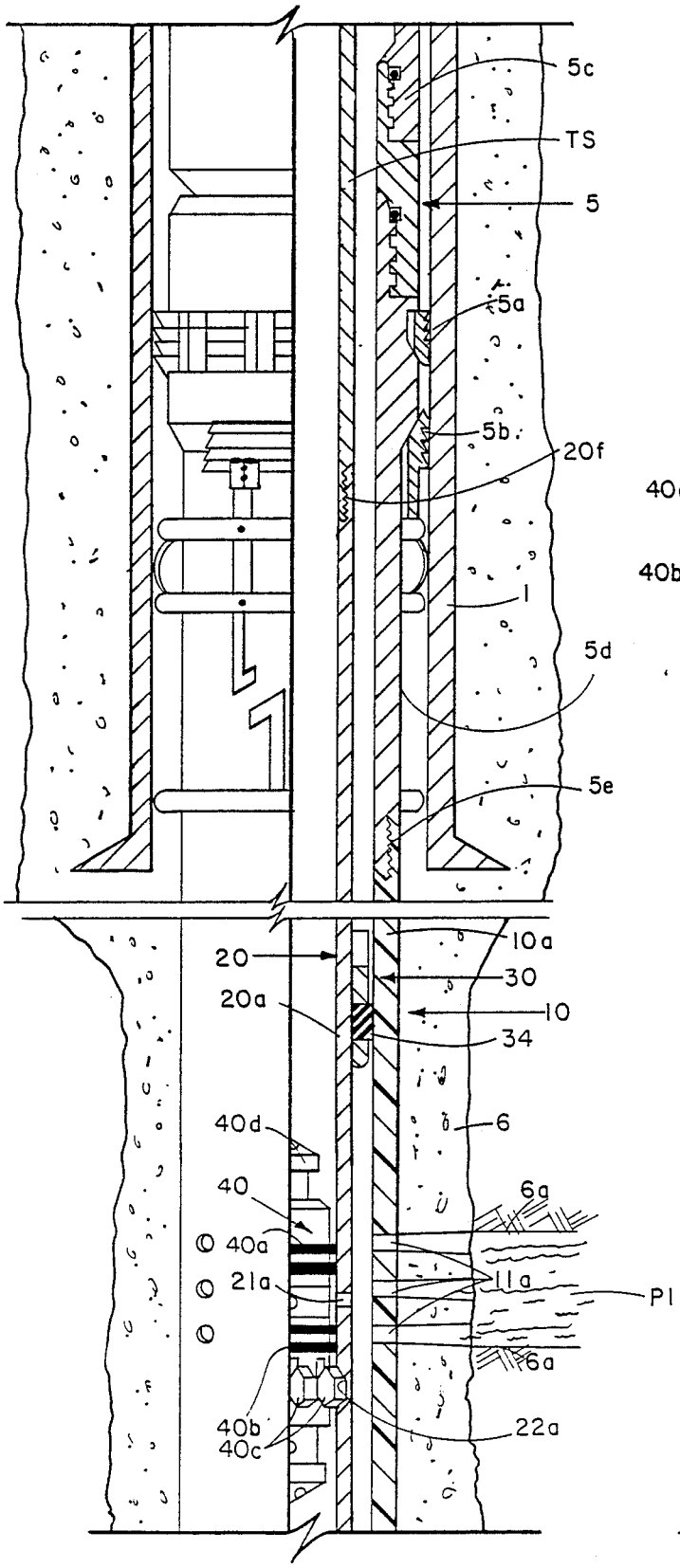
FIGS. 1A, 1B, and 1C collectively represent a vertical quarter sectional view of a treatment tool embodying this invention inserted and set within a well bore.
Figure 1B:
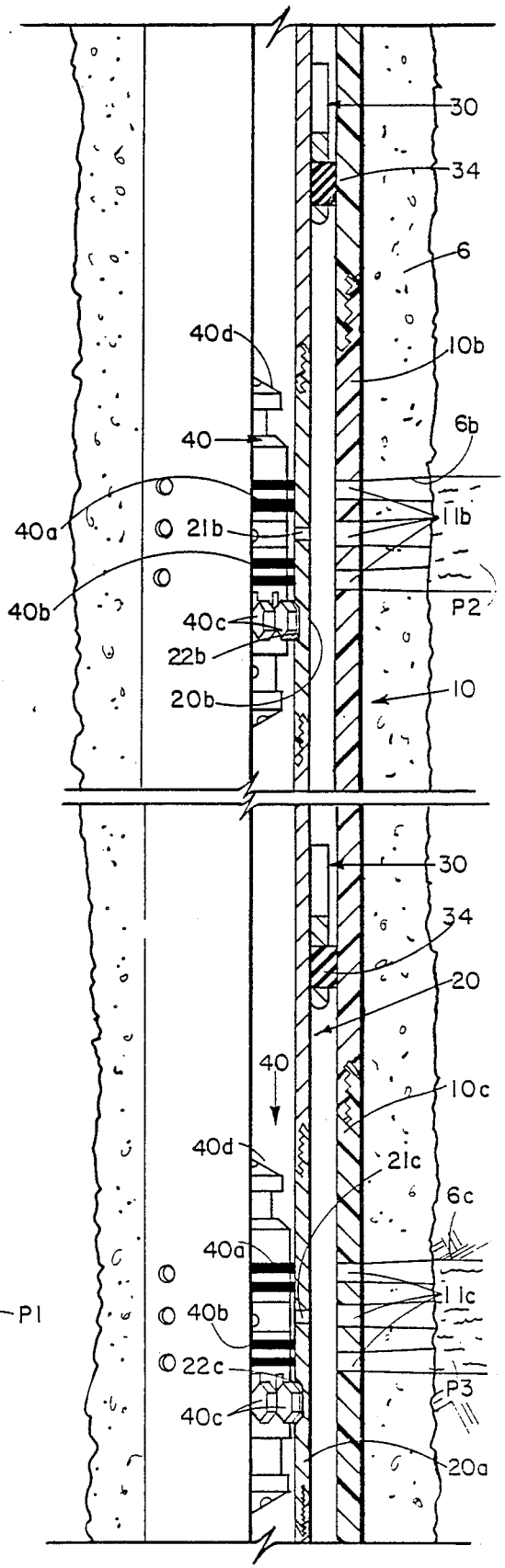
Figure 1C:
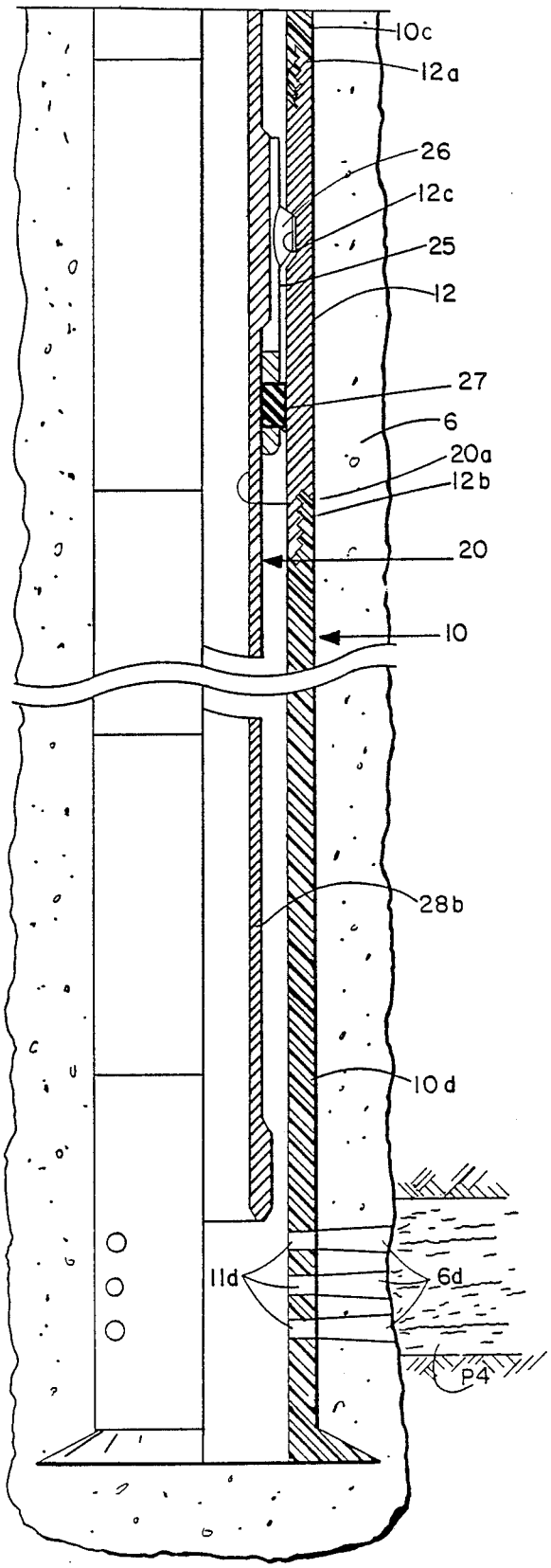

Referring to FIGS. 1A–1C of the drawings, there is shown one embodiment of the invention for effecting the concurrent supply of treatment fluid to four vertically spaced production zones with the amount of such treatment fluid supplied to each of the zones being respectively predetermined.

The apparatus embodying this invention is shown in FIGS. 1A–1C to comprise a tubular liner 10 which is suspended within the bottom portions of the well casing 1 by a conventional hanger 5 having slips **5*a* and 5*b* respectively engaged with the interior wall of casing 2. To minimize costs, the liner 10 is preferably of relatively small diameter, such as 2.5 inches ID. Liner 10 is fabricated by the threaded assemblage of tubular sections 10*a*, 10*b*, 10*c*, etc.. The liner is conventionally secured by threads 5*e* provided on the lower portion of the body 5*d* of the hanger 5**.

After the liner is run into place by a conventional setting tool (not shown) which is engagable with internal lefthand threads (not shown) conventionally provided on an upper sleeve bore portion **5*c* of the hanger 5, and the hanger 5 is set in the bore of casing 2, a conventional cementing operation is provided to fill the annulus between the exterior of the liner 10 and the well bore with cement 6, thus preventing fluid communication along the exterior of liner 10 between vertically spaced production zones P1, P2, and P3. A wireline perforating gun is then inserted in the bore of liner 10 and a plurality of vertically spaced sets of perforations 11*a*, 11*b*, 11*c*, and 11*d* are produced in the wall of liner 10 and also passages 6*a*, 6*b*, 6*c*, and 6*d* through the cement layer 6**.

Because of the small diameter of liner 10, and the fact that such liner will be subjected to acid corrosion during the introduction of carbon dioxide as a treatment fluid for the production zones P1, P2, and P3, it becomes feasible to fabricate the liner sections **1O*a*, 1O*b*, 1O*c***, etc. from a reinforced plastic such as fiberglass-reinforced plastic pipe. Such material is, of course, highly resistant to corrosion and has sufficient tensile strength for the particular application so long as the diameter of the liner is small and the length of the liner is not excessive.

Since the treatment apparatus embodying this invention requires the setting of a packer in the bore of liner 10 at a position immediately above the lowermost set of perforations **11*c*, a metallic section 12 is threadably incorporated in the length of fiberglass-reinforced pipe as by conventional threaded connections 12*a* and 12*b***.

The metallic liner section 12 is further provided with an internal annular locking groove 12c for the purpose of receiving the locking lugs of a packer unit 25 to be hereinafter described.

A tubular assemblage 20, which is conventionally secured at its upper end by threads 20f to a tubing string TS leading to the surface of the well, is then inserted in the bore of the liner 10. Tubular assemblage 20 includes a packer unit 25 which, as previously mentioned, is disposed near the bottom of the assemblage to cooperate with the locking groove 12c provided in the metallic section 12 of the liner. Packer 25 is provided with a plurality of peripherally spaced locking lugs 26 which are expandable into engagement with the locking groove 12c by an apparatus to be hereinafter described. Packer unit 25 further comprises an annular elastomeric packing element 27 which is expandable through the application of compressive force thereto to effect a sealing engagement of the annulus defined between the bore of the liner 10 and the exterior of the tubular assemblage 20. As will be described, packer unit 25 is set by the application of tension to the tubing string, and the expansion of packing element 27 effectively isolates the lowermost set of perforations 11d from the other perforations.

At locations immediately above the remaining sets of perforations 11a, 11b, and 11c, a packing unit 30 is mounted on the tubular assemblage 20 in a manner to be hereinafter described in detail, and incorporates an annular elastomeric sealing element 34 which is expandable into sealing engagement with the bore of the mandrel 10 through the application of tension to the tubing string. Thus each of the sets of perforations 11a, 11b, 11c, and 11d are isolated from each other.

Immediately adjacent each of the sets of perforations 11a, 11b, and 11c, a plurality of peripherally spaced radial ports 21a, 21b, and 21c are respectively provided, thus providing communication between the perforations and the internal bore 20a of the tubular assemblage 20.

Immediately below the ports 21a, 21b, and 21c, the tubular assemblage 20a is provided with internal valve retention grooves 22a, 22b, and 22c, respectively. Such grooves mount a conventional adjustable flow valving unit 40 which is provided with axially spaced external seals 40a and 40b which straddle the radial ports 21a, 21b, or 21c as the case may be, and with radially outwardly biased retention dogs 40c which respectively engage the internal valve retention grooves 22a, 22b, and 22c.

The valve units 40 are a standard commercial unit, and may comprise, for example, the DANIEL RO-1-C valve which is sold by DANIEL EQUIPMENT, INC. of Houston, Tex. Valve 40 is provided with an internal adjustable orifice for dividing fluid flow through the valve into two components, namely an axial component and radial component, and the amount of fluid being diverted into the radial component and hence passing through the ports 21a, 21b or 21c and the respective sets of perforations 11a, 11b, and 11c, may be preselected prior to insertion of the valve into the tubular assemblage 20. Each valve 40 is provided with a fishing neck 40d by which the valve may be conveniently removed by wireline from the tubular assemblage 20 for adjustment of the radial flow rate, in the event that the initially selected adjustment is not satisfactory. The valves 40 can then be reinserted by wireline, thus eliminating any necessity for pulling the entire tubing string to make adjustments to produce the proper flow rate into each of the respective production formations P1, P2 or P3. Since the valve 40 is a standard commercial item, further description of the structure of the valve is deemed unnecessary.

It will be noted that no orifice valve is provided for the lowermost set of perforations 11d. These perforations are supplied with treatment fluid by the residual axial flow. Adjustment of the initial flow rate of treatment fluid introduced into the tubing string will adjust the residual axial flow rate.

Figure 3A:
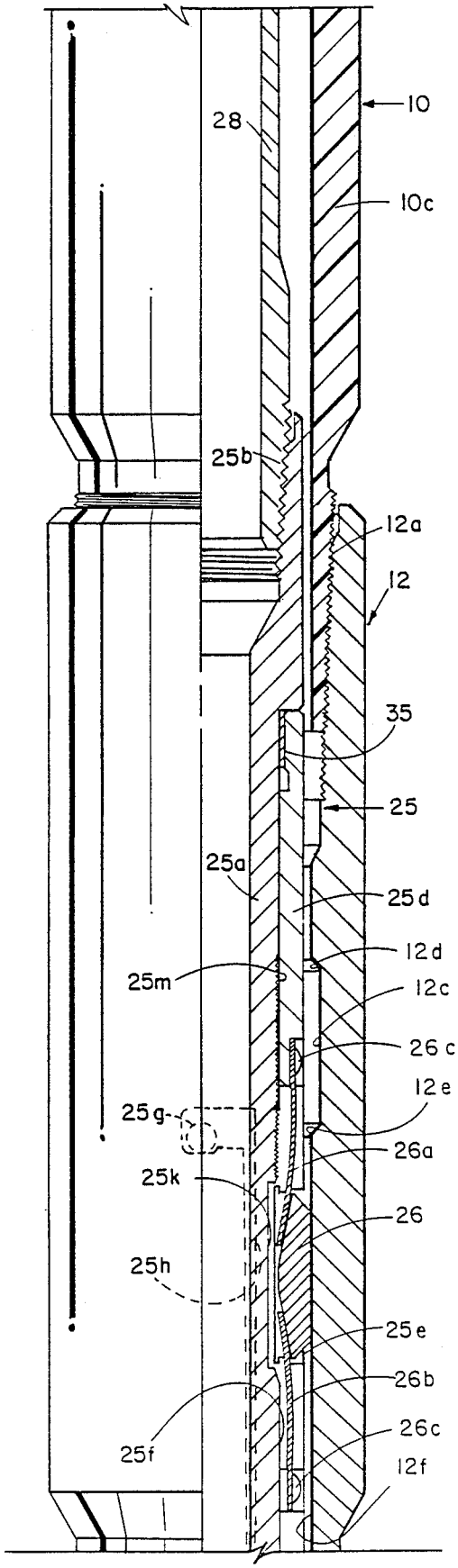
FIGS. 3A and 3B collectively represent an enlarged-scale, quarter sectional view of the lowermost packer unit utilized in all modifications of this invention, with the components of the lowermost packer unit shown in their initial run-in positions.
Figure 3B:
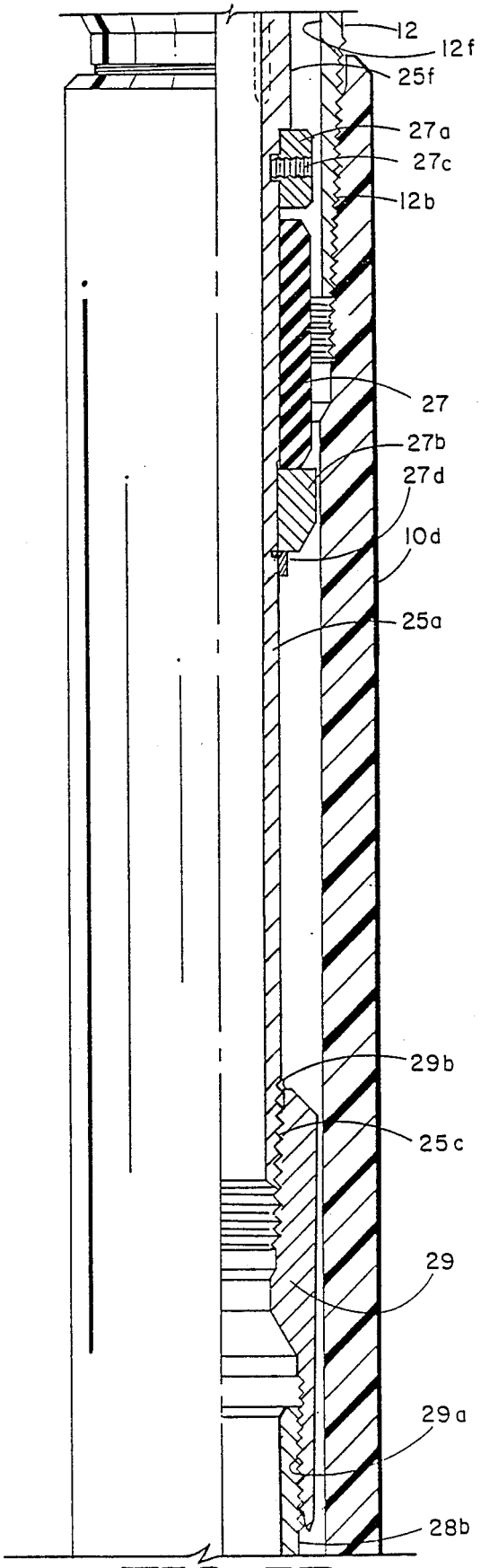
Figure 4B:
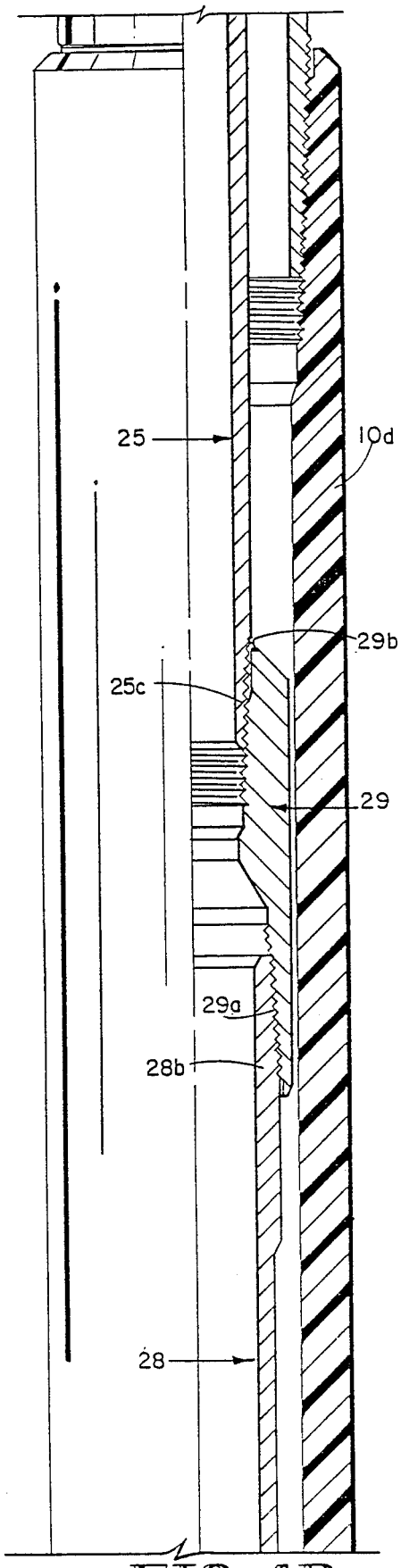

Referring now to FIGS. 3A and 3B, the detailed construction of the lowermost packing element 25 will now be described. As shown in the aforementioned figures of the drawings, the lowermost packing element 25 comprises a tubular inner body member 25a provided with internal threads 25b for conventional securement to the bottom end of a sleeve 28 which extends upwardly to form part of the tubular assemblage 20 which is suspended at its top end from the main tubing string TS (Fig. 1A) extending to the well surface. The lower end of the tubular inner body 25a is provided with external threads 25c which are engaged by the internally threaded upper end of a connecting sub 29. The lower end of connecting sub 29 is provided with internal threads 29a which are engaged with threads provided on the top end of an extension sleeve 28b which extends downwardly to a position adjacent the lowermost set of perforations 21c.

Surrounding the medial portion of the inner tubular body 25a is a lock support sleeve 25d. Lock support sleeve 25d is conventionally milled out to provide a plurality of peripherally spaced recesses 25e for respectively accommodating a plurality of locking elements 26. Each locking element is biased in a radially outward direction by a pair of leaf springs 26a and 26b which are suitably mounted to the lock-supporting sleeve by bolts 26c. Thus, when the lowermost packing element is run into the liner 10 and the lock elements 26 are positioned adjacent the annular locking recess 12c provided in the metallic insert 12 in the liner 10, the locking lugs 26 will be urged outwardly into engagement with locking recess 12c, but may be cammed out of such engagement by the inclined surfaces 12d and 12e provided at the top and bottom ends of the locking recess 12c. Thus, the preferred initial run-in position of the lowermost packing unit 25 places the locking lugs 26 at a position slightly below the annular locking recess 12c as shown in FIG. 3A.

Figure 9:
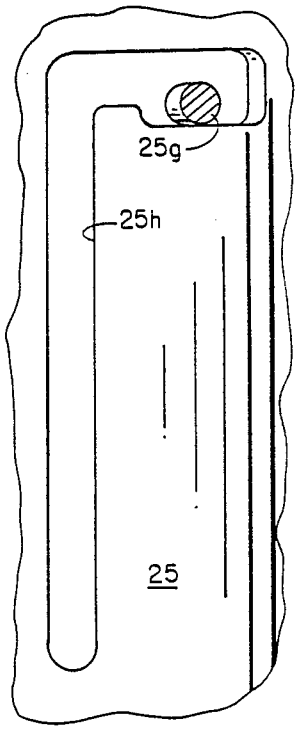
FIG. 9 is a developed view of the J-slot employed in the lowermost packing unit.
Figure 10A:
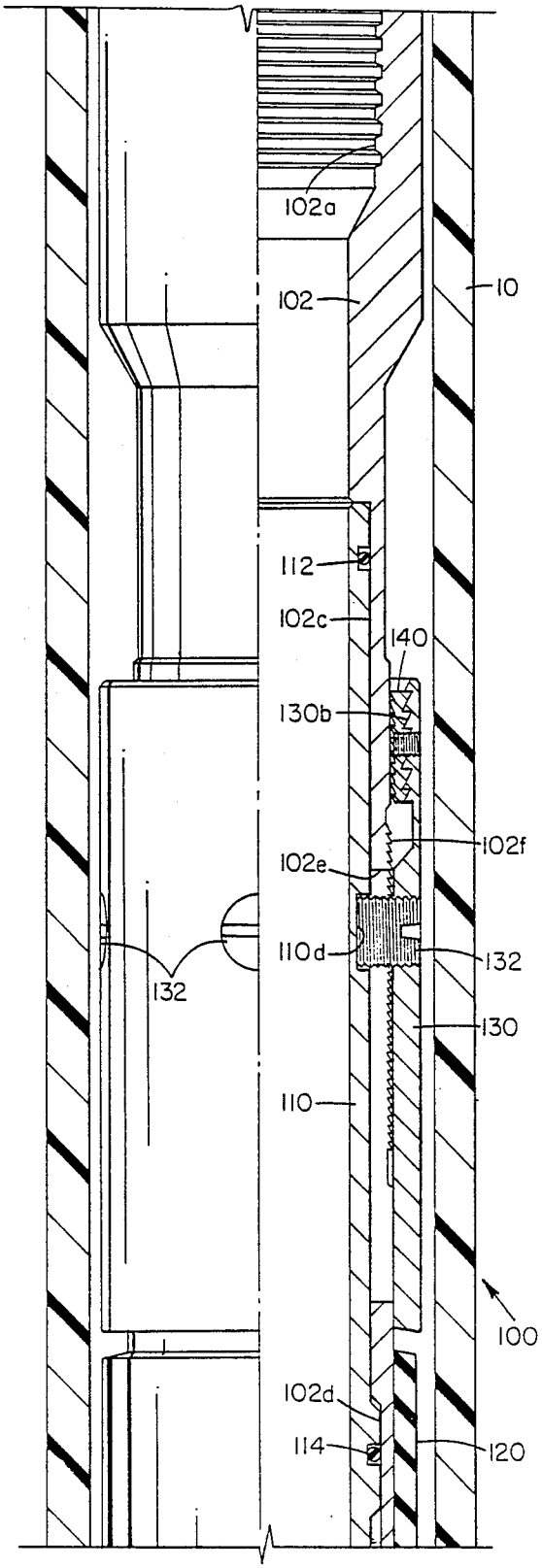
FIGS. 10A and 10B collectively constitute a vertical quarter section view of a modified upper packing element in its run-in position.
Figure 10B:
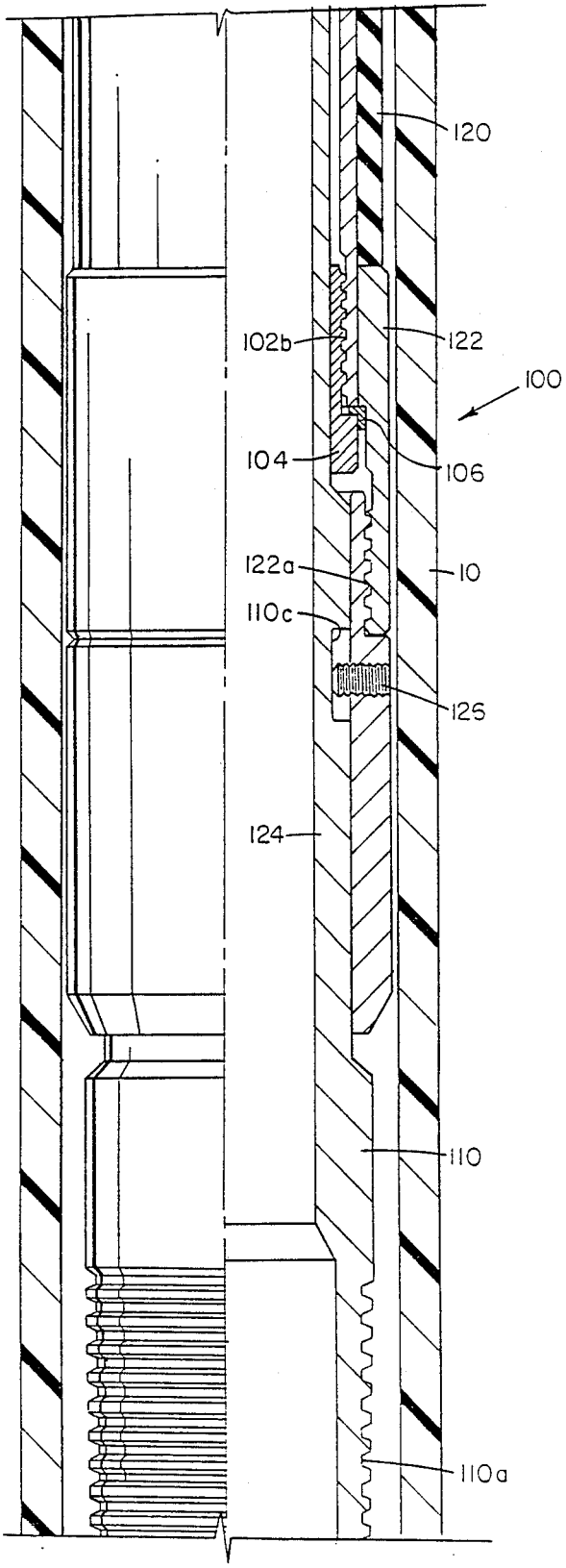

The lock support sleeve 25d is connected to the inner tubular body 25a for run-in purposes by an inwardly projecting J-pin 25g which is threadably mounted in the lock support sleeve 25d and cooperates with a J-slot 25h (FIG. 9) provided on the exterior surface of the inner tubular body 25a. In the run-in position, the J-pin 25g is engaged in the horizontal leg of the J-slot 25h and hence the lock support sleeve 25d moves concurrently with the tubular inner body 25a to the run-in position illustrated in FIG. 3A.

Figure 4A:
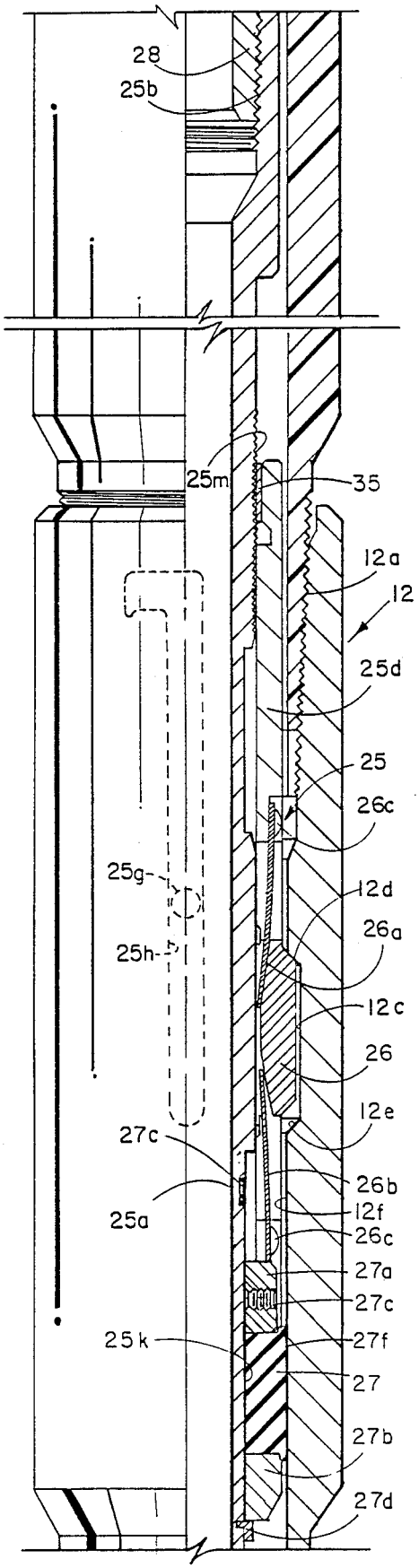
FIGS. 4A and 4B respectively constitute views similar to FIGS. 3A and 3B but showing the lowermost packer unit in its set position.

The tubing string is then rotated in a counter clockwise direction a sufficient amount to move the J-pin 25g into alignment with the vertically extending portion of the J-slot 25h and tension is then applied to the tubing string to elevate same and this brings the locking lugs 26 upwardly into alignment with the lock receiving recess 12c provided in the metallic liner section 12. The application of tension to the tubing string is continued, resulting in the upward movement of the tubular inner body 25*a* relative to the lock support sleeve 25*d*. Such upward movement brings an enlarged-diameter portion 25*f* of the tubular inner body into a position adjacent the locking lugs 26 and prevents such locking lugs from being cammed out of the lock receiving recess 12*c*, thus effectively locking the lock support sleeve in a fixed axial position (FIG. 4A).

Below the lock support sleeve 25*d*, a pair of axially spaced abutment rings 27*a* and 27*b* are mounted on the tubular inner body 25*a* in axially spaced relationship, and respectively abut the top and bottom faces of the annular elastomeric sealing element 27. The upper abutment ring 27*a* is secured to the inner body 25*a* by shear screws 27*c*. The lower abutment ring 27*b* is shearably secured to the tubular inner body 25*a* by a shear ring 27*d*. When the locking lugs 26*c* are engaged with the annular locking recess 12*c*, the upper abutment ring 27*a* is in abutting engagement with the bottom end of the lock support sleeve 25*d*, and thus prevents further upward movement of the annular elastomeric sealing element 27 until shear screws 27*c* are severed. As the upward movement of the tubular inner body 25*a* then continues, the annular elastomeric seal element 27 is axially compressed and expands into sealing engagement with the bore 12*f* of the liner section 12 and the external surface 25*k* provided on the inner tubular body 25*a*, as illustrated in FIG. 4A. Thus, the packing element 25 is fully set and is not only anchored to the liner 10 by the locking lugs 26 but also effects a sealing engagement of the annulus between the bore of the liner 10 and the external surface of the tubular inner body 25*a*, thus isolating the lowermost set of perforations 11*d* from all of the other perforations.

In order to permit the tension applied through the tubing string to the lowermost packing element 25 to be relaxed, a body lock ring 35 is mounted in the bore of the top end portion of the lock support sleeve 25*d*. Such body lock ring cooperates with conventional wicker threads 25*m* provided on the top portion of the inner tubular body 25*a*. Thus, the tension may be released in the tubing string without effecting the unsetting of the lowermost packing element 25.

Figure 5A:
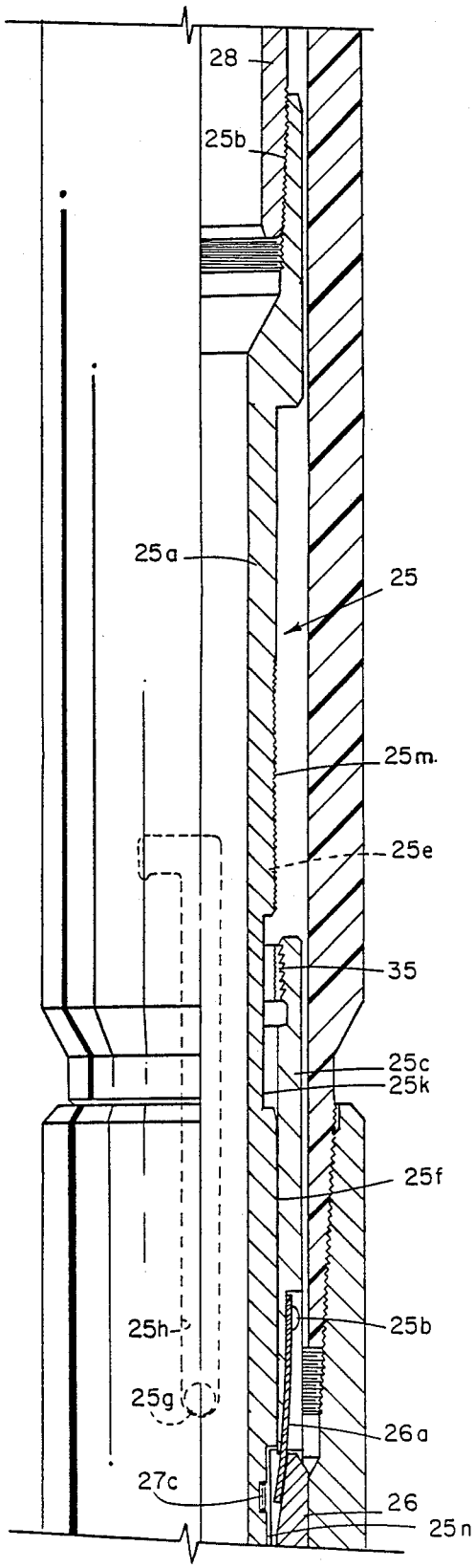
FIGS. 5A and 5B are views respectively similar to FIGS. 3A and 3B, but showing the components of the lowermost packer unit in the positions assumed during the unsetting of such packer.
Figure 5B:
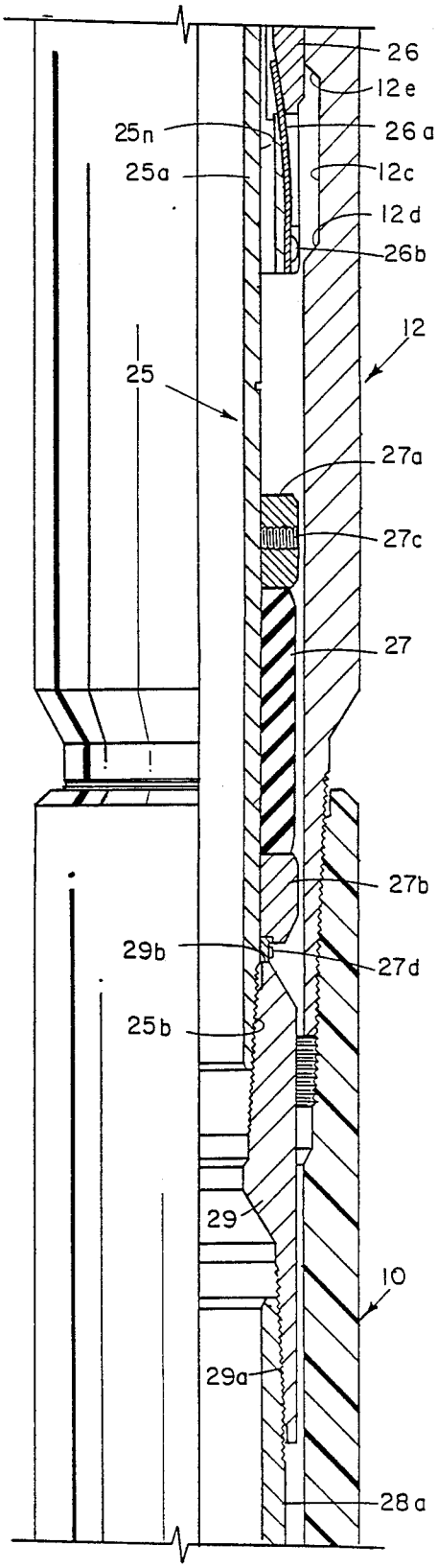

To effect the unsetting of the lowermost packing element 25, a substantially higher degree of tension is applied to the inner tubular body 25*a* than required to effect the setting of the lowermost packing element 25. This degree of tension is selected to exceed the shear strength of the shear ring 27*d* which holds the lower abutment ring 27*b* in compressing relationship with respect to the annular elastomeric element 27. Once the shear ring 27*d* separates, the lower abutment ring 27*b* is free to move downwardly and thus remove the compressive forces on the annular elastomeric sealing element 27 (FIGS. 5A, 5B, and 5C). Upward movement of the tubing string will then bring a second smaller diameter surface 25*k* of the inner tubular body 25*a* into alignment with the inner faces of the locking lugs 26. Such locking lugs will be cammed out of the locking recess 12*c* by an inclined upper shoulder 12*d*, thus releasing the lowermost packing element 25 from its locked relation with respect to the liner section 12. All of the outer components of the lowermost packing assembly 25 are then removable from the well with the inner tubular body portion 25*a* through the engagement of the top surface 29*b* of the connecting sub 29 with the shear ring 27*d*.

Figure 6A:
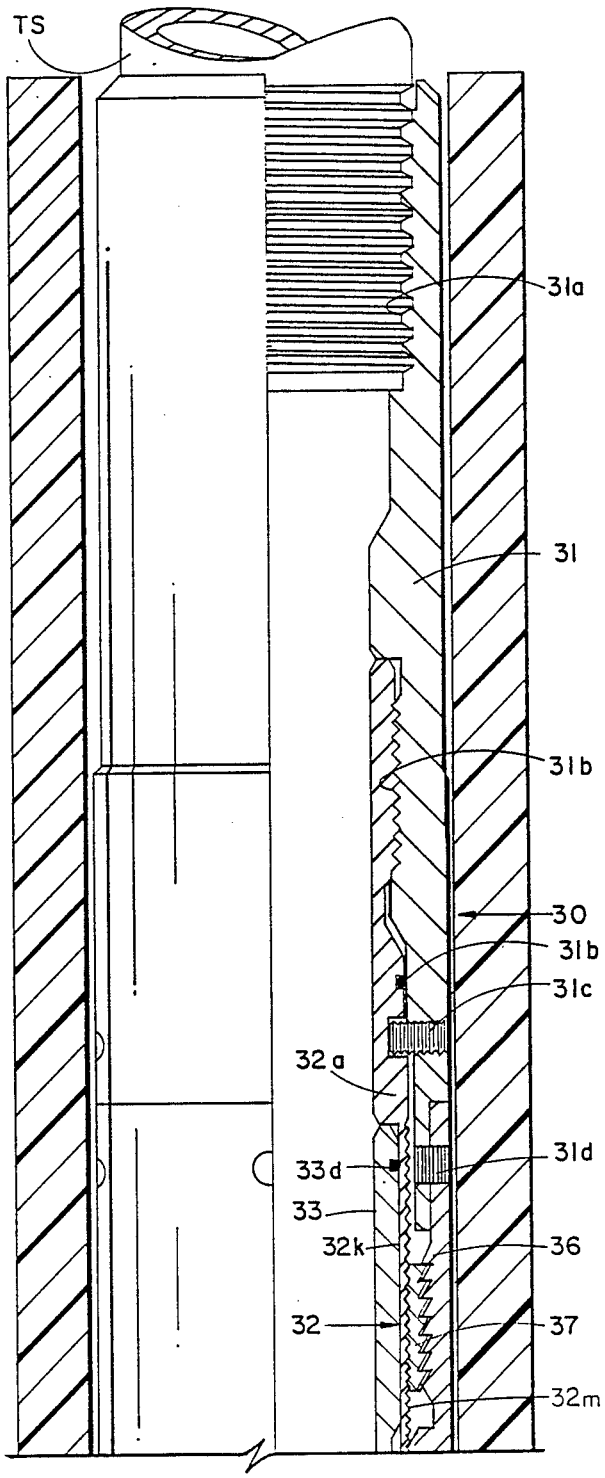
FIGS. 6A, 6B, and 6C collectively constitute an enlarged-scale, vertical quarter section view of the upper packing elements utilized in two modifications of this invention, with the components in their initial run-in positions.
Figure 6B:
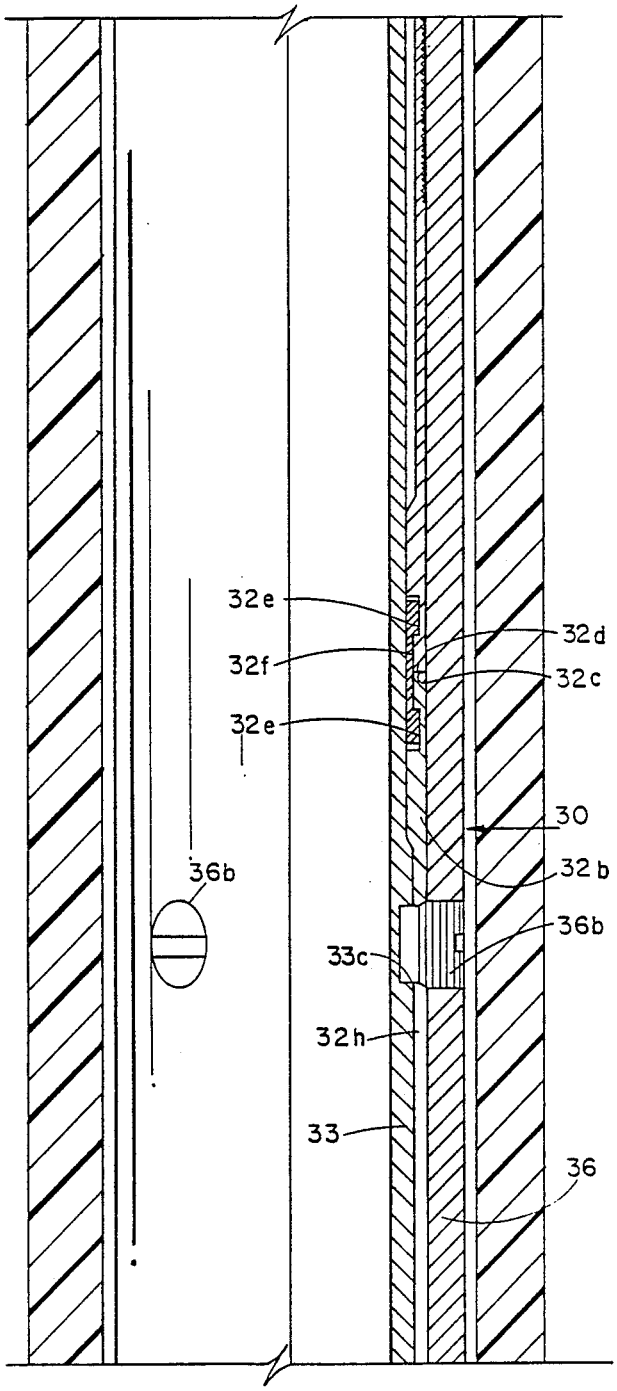
Figure 6C:
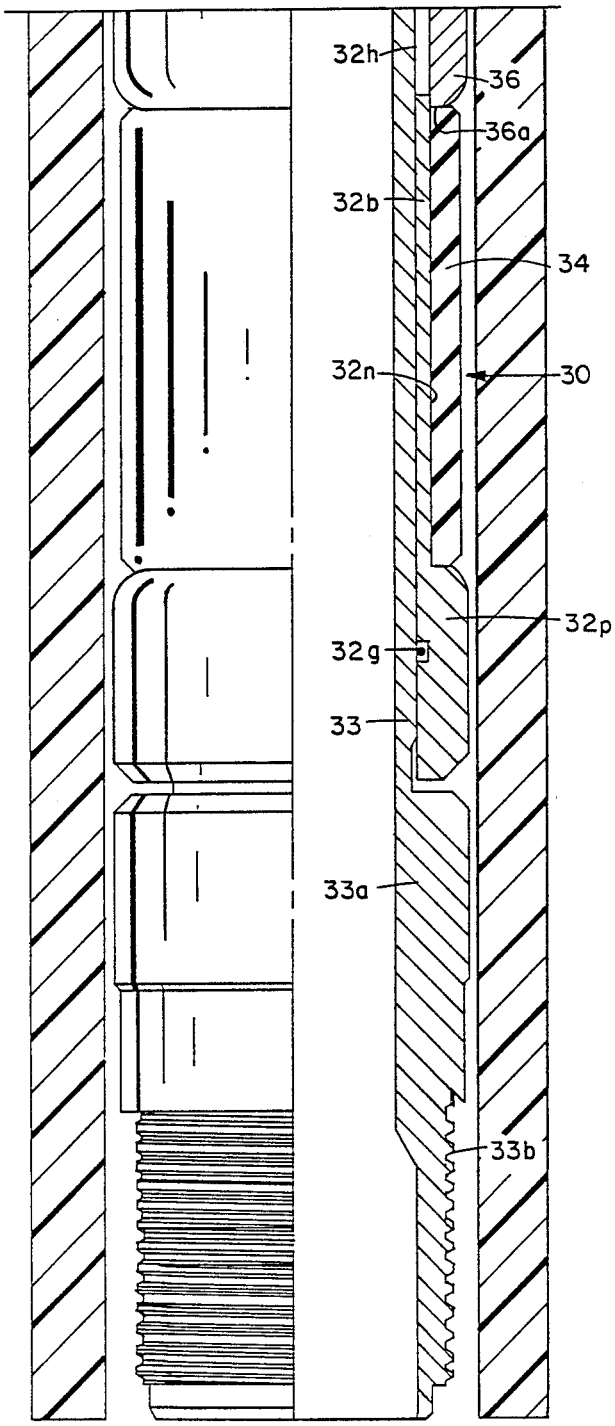

Referring now to FIGS. 6A, 6B, and 6C there is shown in enlarged detail the construction of the upper packing elements 30. Such units comprise an upper connecting sub 31 having internal threads 31*a* for connection to either the bottom of the tubing string (not shown) or the bottom of a tubing element forming part of the tubular assemblage 20. Connecting sub 31 is provided with internal threads 31*b* by which it is connected to the upper end of an axially split, two-piece mandrel assemblage 32. The threaded connection is sealed by an O-ring 31*b* and a set screw 31*c*. The upper piece 32*a* has a bottom end surface 32*c* (FIG. 6B) lying in abutment with the top end surface 32*d* of the lower mandrel portion 32*b*. Immediately adjacent the abutting surfaces 32*c* and 32*d*, the top and bottom sections 32*a* and 32*b* are both provided with an annular recess 32*e*. A shear ring 32*f* is contoured to engage both annular recesses 32*e* and thus secure the upper and lower mandrel pieces 32*a* and 32*b* for co-movement. Shear ring 32*f* may be fabricated as a split C-ring construction in order to facilitate assemblage.

The lower portion of lower mandrel portion 32*b* is radially enlarged as indicated at 32*p* and such lower portion mounts an O-ring 32*g* which sealably engages the external surface of a connecting sleeve 33. Connecting sleeve 33 has an enlarged-diameter lower portion 33*a* which is provided with external threads 33*b* for engagement with the next tubing portion of the tubular assemblage 20.

The radially enlarged portion 32*p* of the lower mandrel piece 32*b* abuts the bottom face of an annular elastomeric sealing element 34. The upper face of the annular elastomeric sealing element 34 is abutted by the bottom end face 36*a* of a compressing sleeve 36. Sleeve 36 mounts a plurality of peripherally spaced, inwardly projecting bolts 36*b* each of which extends through a vertical slot 32*h* provided in the lower mandrel piece 32*b* and engages a recess 33*c* formed in the medial portions of the connecting sleeve 33. The top end of connecting sleeve 33 mounts an O-ring 33*d* which is disposed in sealing relationship with the internal surface of the upper mandrel piece 32*a*.

The top end of the compression sleeve 36 is shearably secured to the bottom end of the connecting sub 31 by a plurality of peripherally spaced shear screws 31*d*. Additionally, the compression sleeve 32 conventionally mounts a body lock ring 37 which is engagable with wicker threads 32*m* provided on the exterior of the upper mandrel piece 32*a*.

Figure 7A:
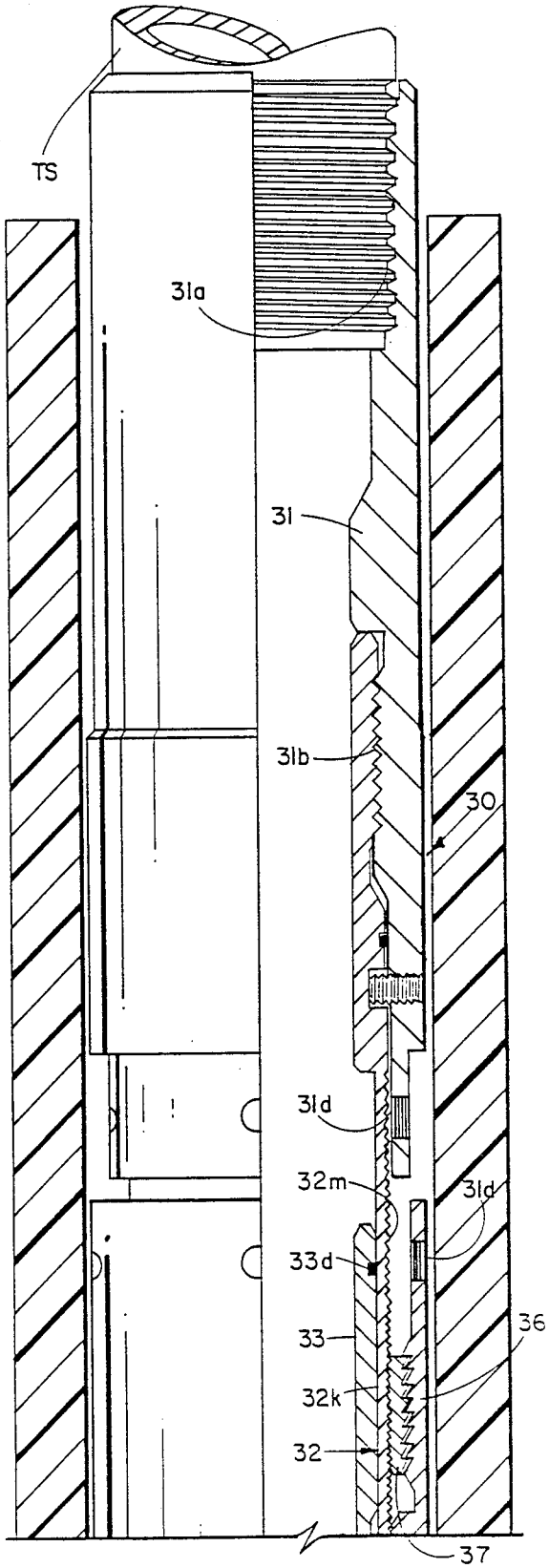
FIGS. 7A, 7B, and 7C respectively correspond to FIGS. 6A, 6B, and 6C but show the components of the upper packing elements in their set positions.
Figure 7B:
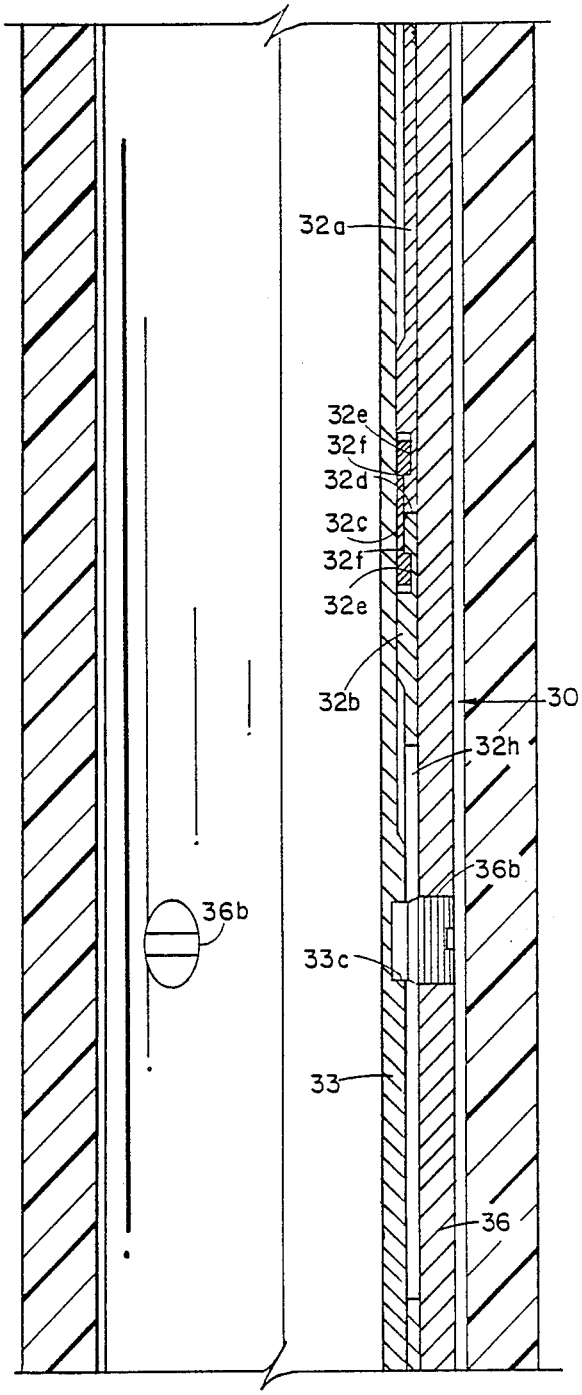
Figure 7C:
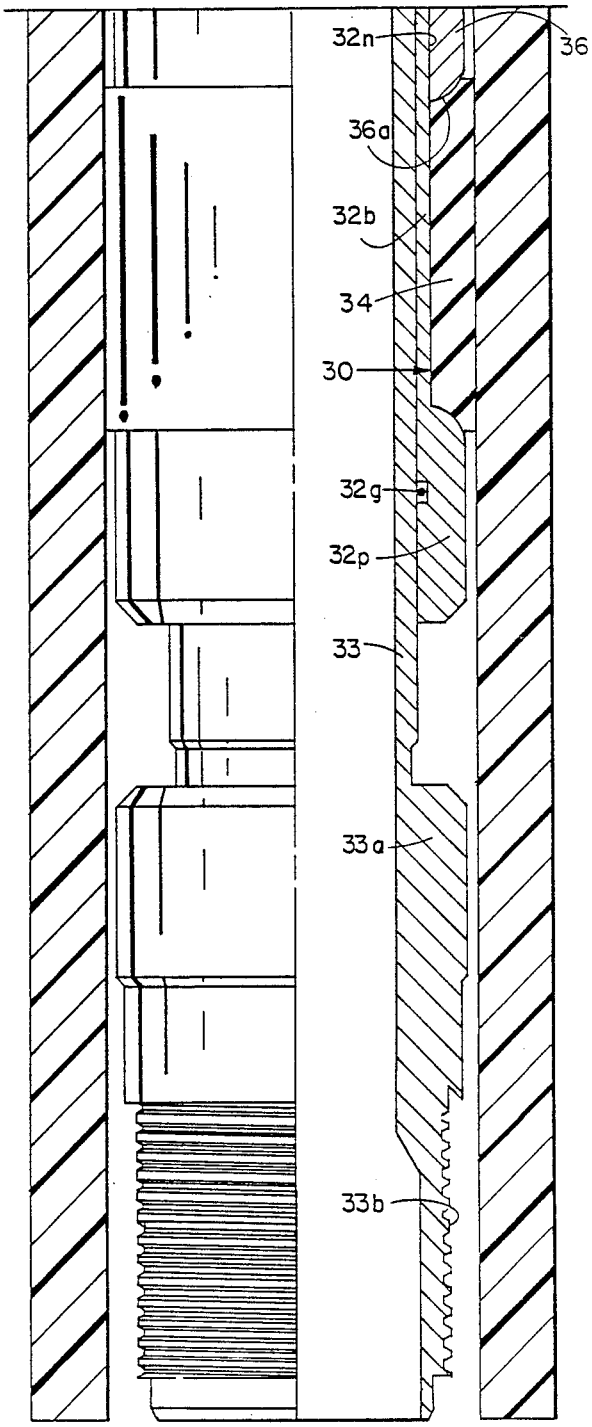

The operation of the upper packing units 30 may now be described. FIGS. 6A, 6B, and 6C illustrate the run-in position of the elements wherein they are disposed in the manner heretofore described. After setting of the lowermost packing unit 25, any tensile forces imparted to the lowermost packing unit must pass through the upper packing elements 30. When such tension reaches a degree to effect the shearing of shear bolts 31*d*, the severance of such shear bolts permits the mandrel assemblage 32 to move upwardly relative to the compression sleeve 36 and thus effect an axial compression of the annular elastomeric sealing element 34, causing such element to radially expand to seal the annulus between the bore of the liner 10 and the external surface 32*n* of the lower mandrel piece 32*b* (FIGS. 7A, 7B, and 7C). The sealing of the annulus is completed by O-ring seal 32*g* below the elastomeric sealing element 34 and O-ring seal 33*d* above the elastomeric sealing element 34. Upward movement of the compression sleeve 36 is prevented by the bolts 36*b* which traverse the vertically extending slots 32h provided in the lower mandrel piece 32b.

When the desired degree of expansion of the annular elastomeric sealing element 34 has been accomplished, the body lock ring 37 will prevent any return movement of the mandrel in a downward direction to release the compressive forces on the annular elastomeric sealing element 34. Thus, the elements of the upper packing units 30 assume the configuration illustrated in FIGS. 7A, 7B, and 7C.

Figure 8A:
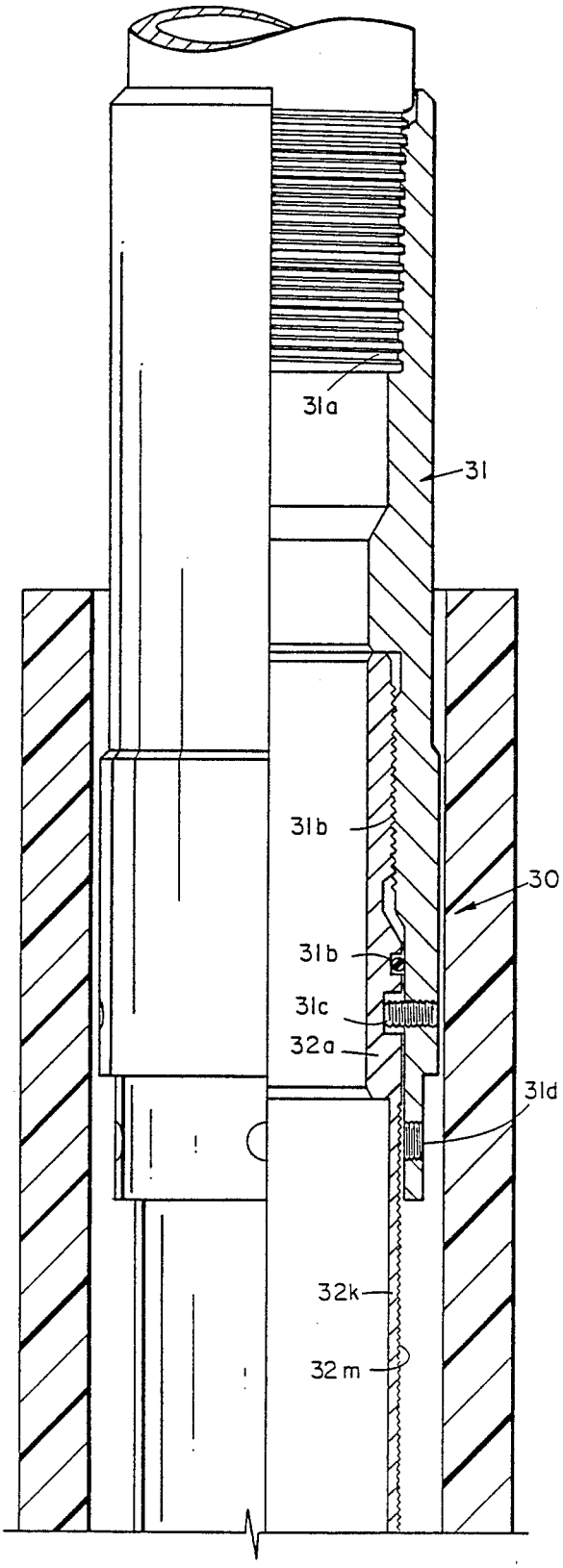
FIGS. 8A, 8B, and 8C are views respectively corresponding to FIGS. 6A, 6B, and 6C but showing the components of the upper packing elements in the positions assumed during the unsetting of such packer elements.
Figure 8B:
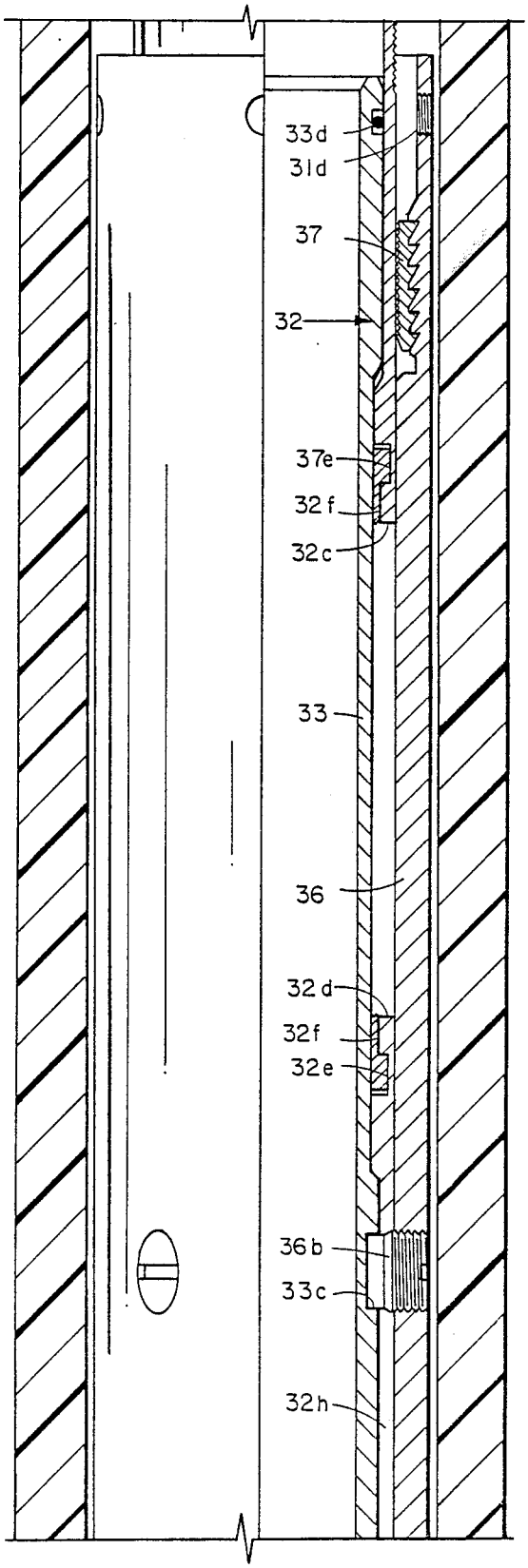
Figure 8C:
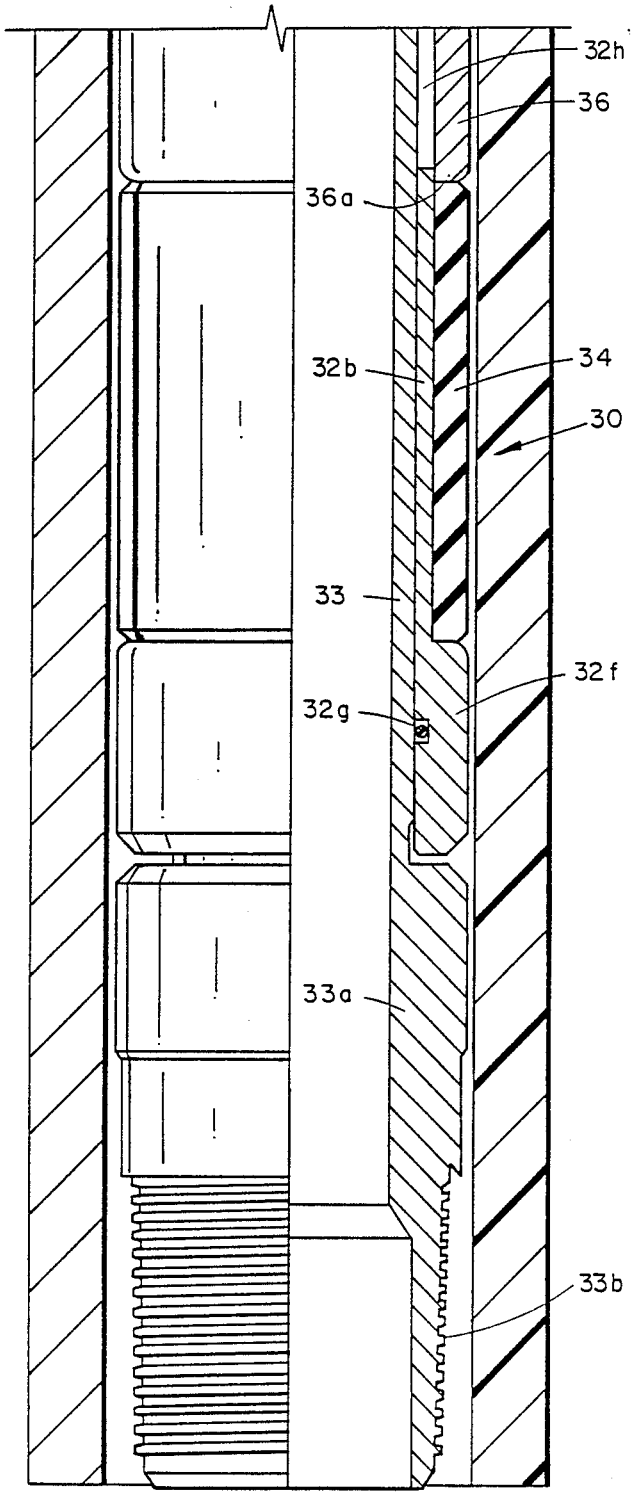

Each upper packing unit 30 may be unset through the application of a tension force through the tubing string substantially greater than the force required to effect the setting of such packing unit. Such force should be sufficient to effect the separation of the shear ring 32f, which effects the immediate release of the lower mandrel piece 32b, thus removing the compressive force on the annular elastomeric sealing element 34 (FIGS. 8A, 8B, and 8C).

The shear strength of the shear ring 32f should be less than that required to effect the shearing of the shear ring 27d of the lowermost packer unit 25. The lowermost packer unit 25 must remain in an anchored position relative to the liner 10 until all of the shear rings 32f of the upper packing elements 30 are sheared to unset each of the upper packing elements 30 prior to unsetting of the lowermost packing element 25, which provides the required resistance to tension applied through the tubing string to effect the shearing of the unsetting shear rings 32f of the upper packing elements 30.

Those skilled in the art will recognize that the aforedescribed method and apparatus provides an unusually simple and economical solution to the problem of concurrently supplying treatment fluid, be it liquid or gas, to a plurality of vertically spaced production zones traversed by a well bore. Not only is such treatment fluid concurrently applied, to all production zones, but the amount or flow rate of the treatment fluid supplied to each of the production zones may be selectively adjusted.

Referring now to FIGS. 2A, 2B, 2C, and 2D there is shown a modification of this invention which is useful whenever the interior diameter of the casing 1 is large enough to accommodate a conventional side pocket mandrel in the tubing string. Referring to these drawings, wherein similar numbers indicate components similar to those previously described, it will be noted that the liner 10 is identical to that previously described and is suspended from the hanger 5 in the same manner as described. The tubular assemblage 20, however, is now connected at its upper end by threads 20f to a lower inner portion 60a of a conventional side pocket mandrel 60. Side pocket mandrel 60 is in turn connected in series relationship to the lower end of the tubing string (not shown). An extension sleeve 62 connected by threads 62a to the outer bottom end of the side pocket mandrel 60 and sleeve 62 is provided at its bottom end with a radially thickened portion 62b in which are mounted a plurality of axially spaced seals 62c. Seals 62c effect a sealing engagement with the extension sleeve 5c provided on the hanger 5. Thus the side pocket mandrel 60 may move axially with respect to the hanger 5, but maintains sealing engagement with the bore of the extension sleeve 5c.

Side pocket mandrel 60 is provided with a conventional interior side pocket 65 within which is conventionally mounted an adjustable axial flow-controlling valve 70. Such valve is entirely conventional and may comprise the DANIEL RO-1-C valve sold by DANIEL EQUIPMENT, INC. of Houston, Tex., but modified with respect to the same valve utilized in the modifications of FIGS. 1A, 1B, and 1C to provide an adjustable axial flow outlet instead of a radial flow outlet. Thus the treatment fluid introduced through the tubing string will be divided by the adjustable flow valve 70 into an inner axial component which proceeds down the bore 20a of the tubular assemblage 20, and a second axially flowing component which proceeds down the annulus 20g defined between the exterior of the tubular assemblage 20 and the internal bores of the hanger 5 and the liner 10.

In this modification, the uppermost packing element 30 which was previously disposed above the uppermost set of perforations is eliminated and the axial flow component of treatment fluid enters the perforations 11a directly from the annular flow passage 20g. The amount of this flow is adjustable by adjustment of the adjustable flow valve 70. For this purpose, the adjustable flow valve 70 is provided with a fishing neck 70a by which the valve may be conveniently retrieved by wireline for adjustment purposes and then reinserted in the side pocket 65 of the side pocket mandrel 60.

It will be noted that the annular flow passage 20g is sealed off at its lower end by the packing element 30 sealably located in such annulus above the next set of perforations 11b.

Figure 2A:
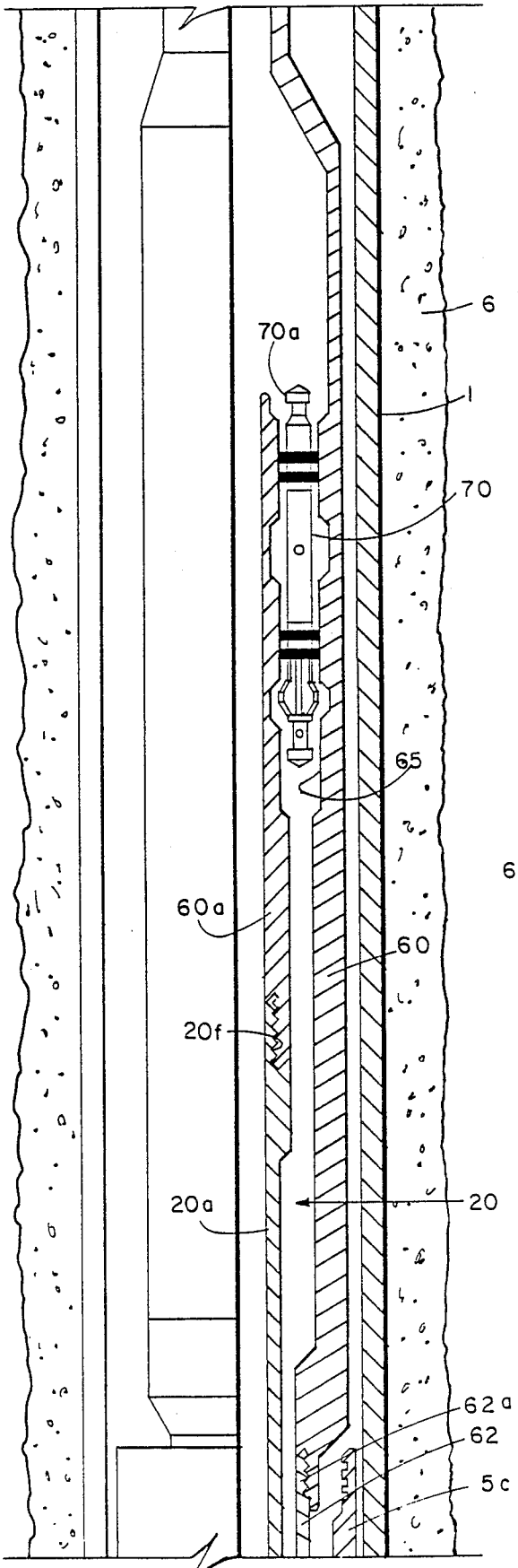
FIGS. 2A, 2B, 2C, and 2D collectively represents a quarter sectional view of a modified tool embodying this invention showing the tool inserted and set in a well bore.
Figure 2B:
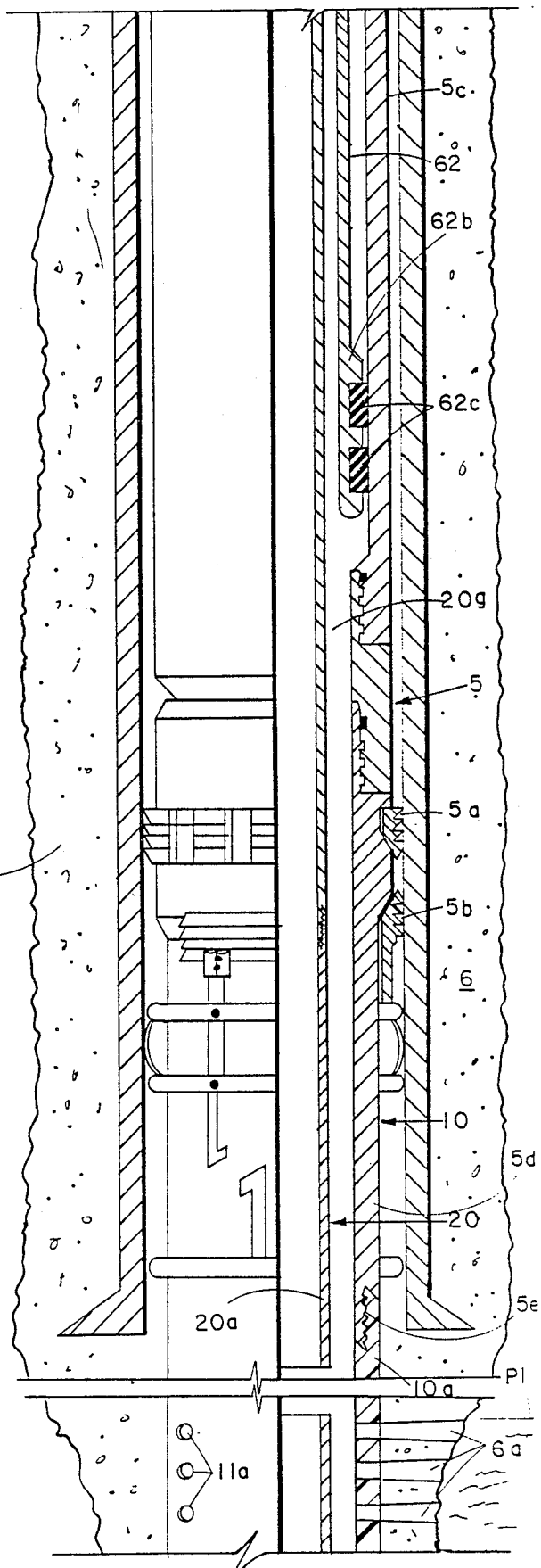
Figure 2C:
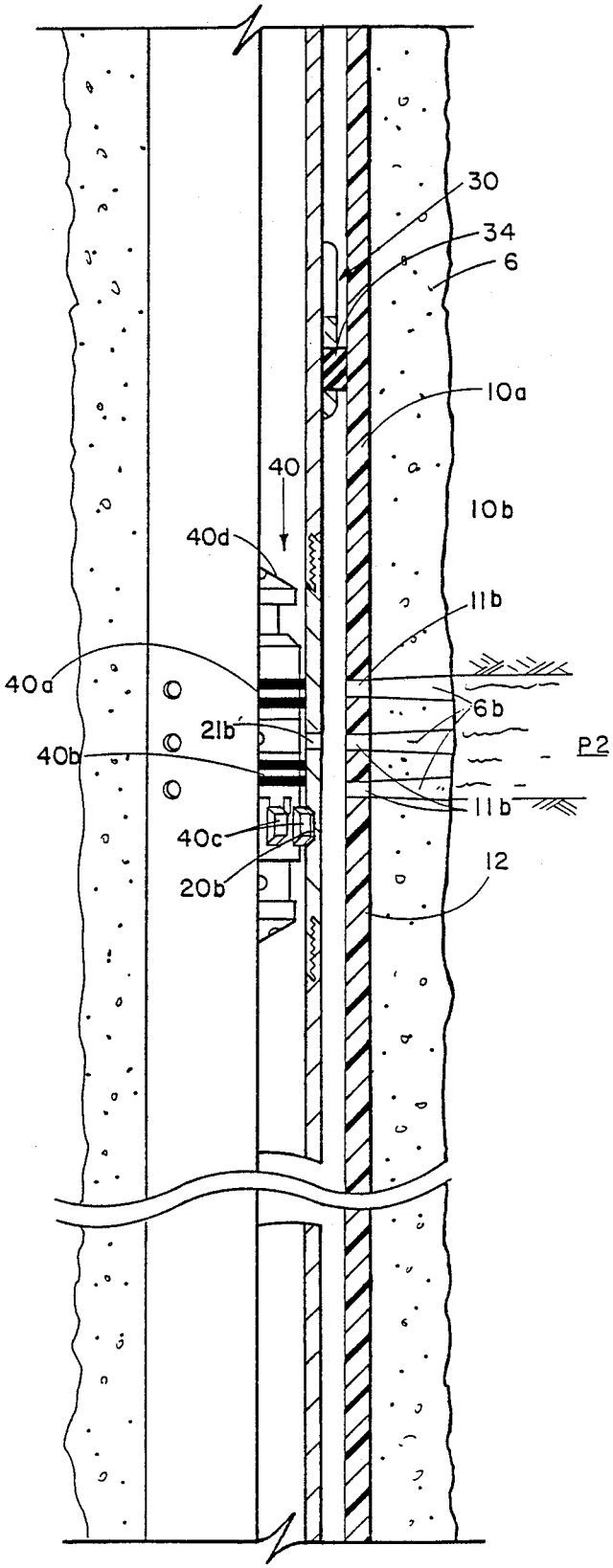
Figure 2D:
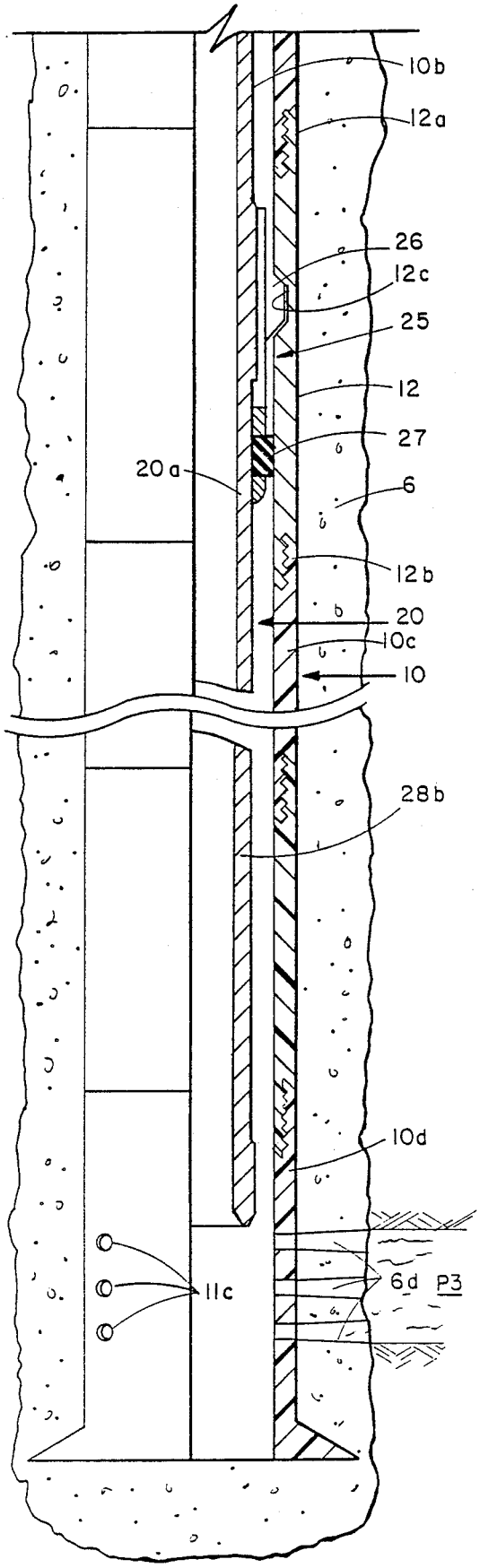

The modification of FIGS. 2A, 2B, and 2C is particularly useful whenever only two or three perforating zones are to be concurrently treated. With such arrangement, the adjustable flow valve 70 may be directly removed by wireline for adjustment purposes. In contrast, in the modification of FIGS. 1A, 1B, and 1C, it is necessary to remove any flow valves 40 located above the particular valve requiring adjustment before that valve can be reached by wireline and removed for adjustment purposes.

The modification of FIGS. 2A, 2B, 2C, and 2D incorporates a lower packer unit 25 which is set above the lowermost set of perforations in the same manner as described in the modification of FIGS. 1A, 1B, and 1C, as well as upper packing units 30. Both the packer unit 25 and all upper packing units 30 are set through the application of tension through the tubing string in the manner previously described.

Referring now to FIGS. 10A, 10B, 11A, and 11B, there is shown a modified construction of a packing unit 100. Unit 100 incorporates an upper tubular body member 102 having internal threads 102a for conventional engagement with the tubular assemblage 20. The lower end of the tubular body 102 is provided with internal threads 102b which are threadably engaged with an abutment sleeve 104. Abutment sleeve 104 secures a shear ring 106 in a radially projecting position immediately below the end of the body sleeve 102.

An inner body sleeve 110 is mounted in concentric telescopic relationship to body sleeve 102 and is provided at its lower end with external threads 110a for securement to the next section of the tubular body assemblage 102. An O-ring seal 112 is provided on the exterior of the inner body member 110 adjacent the upper end of such body member and a second O-ring 114, which is of somewhat larger diameter is secured to a medial portion of the inner body member 110. Such seals engage the bore surfaces 102c and 102d of the inner body member 102 in slidable and sealable relationship.

An annular elastomeric seal 120 surrounds the lower portions of the outer body member 102. A seal compressor sleeve 122 also surrounds the lower end of the outer tubular body 102 and is secured by internal threads 122*a* to the top end of a shear pin ring 124. Shear pin ring 124 slidably surrounds the exterior of the inner tubular body 110 and is provided with one or more radially inwardly projecting shear screws 126 which engage an annular groove 110*c* provided on the exterior of the inner tubular body 110.

An abutment sleeve 130 is mounted in surrounding relationship to the upper portions of the outer tubular body 102 and is secured in a fixed axial position relative to the inner tubular body 110 by one or more radially disposed bolts 132 which are threadably secured in the abutment sleeve 130 but project through axially extending slots 102*e* formed in the outer tubular body 102. The anchor bolts 132 snugly engage an annular groove 110*d* formed in the upper portions of the inner tubular body 110.

Figure 11A:
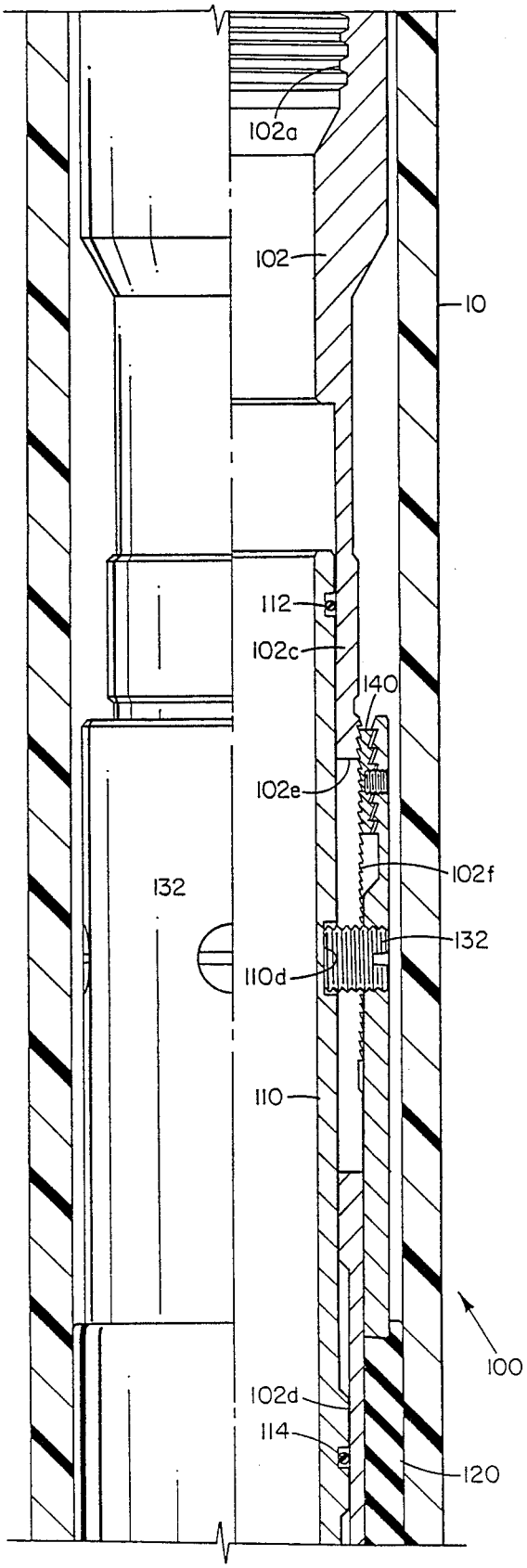
Figs 11A and 11B are views similar to FIGS. 10A and 10B but with the upper packing element in a set position.
Figure 11B:
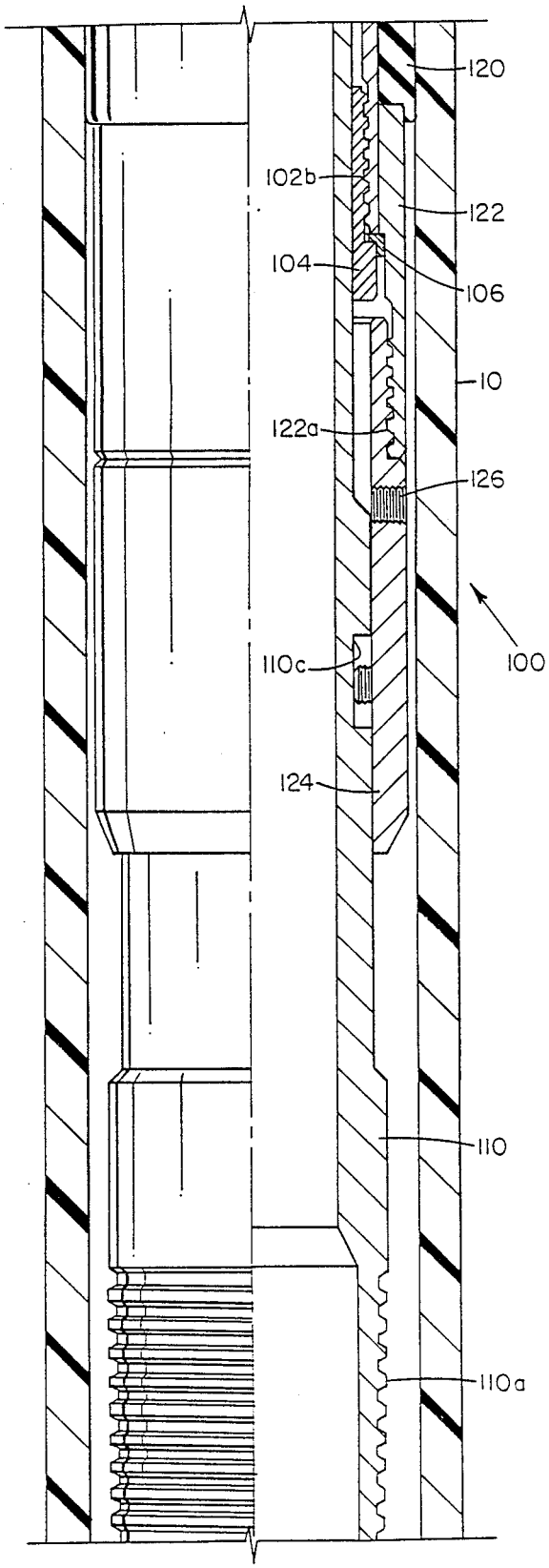

Assuming that the lower end of the tubular body assembly is anchored by a lower packing element in the manner heretofor described, the exertion of an upward tensile force on the outer tubular body 102 will first effect a shearing of the shear screws 126, thus permitting the outer tubular body 102 to move upwardly relative to the inner tubular body 110 and the abutment sleeve 130. The compression sleeve 122 is therefore carried upwardly by the outer tubular body 102 and effects a compression of the annular elastomeric seal element 120 into sealing engagement with the adjacent wall of the fiberglass reinforced liner 10, as illustrated in FIGS. 11A and 11B, thus setting the upper packing element 100. The packing element is retained in a set position through the co-operation of a body lock ring 140 which is conventially mounted between internally projecting threads 130*b* formed on the interior of the abutment sleeve 130 and wicker threads 102*f* formed on the exterior of the outer tubular body 102. Thus, tension can be relieved on the outer tubular body 102 and the packer will remain in its set, sealed relationship with the bore of the thermoplastic liner 10.

To unset the modified upper packer 100, it is only necessary to apply a greater degree of tension than that employed in setting the packer. Such larger tensile force will effect the shearing of the shear ring 106 and thus immediately permit the compression sleeve 120 to shift downwardly to relax the compressive forces on the annular elastomeric seal element 120. All of the elements of the packer can then be removed with the tubing assemblage 20, if desired.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for isolating a set of perforations in a well conduit wall comprising, in combination, a tubular assembly insertable by a tubing string into the well conduit carrying axially spaced lower and upper packer units; said lower packer unit being positionable in the well conduit below the perforations and said upper packer unit being thereby located above said perforations; said lower packer unit including radially expandable means for lockingly engaging the conduit wall and a first annular seal axially compressible to sealingly engage the conduit wall; said upper packer unit including a second annular seal axially compressible to sealingly engage the conduit wall; means responsive to tension in the tubing string to first position said radially expandable locking means in locking engnagement with the conduit wall and then axially compress first annular seal to set said lower packet unit; and means operative after setting of said lower packer unit and responsive to additional tension in the tubing string for axially compressing said second annular seal to set said upper packet unit, thereby isolating said perforations.

2. The apparatus of claim 1 further comprising means responsive to a tension in the tubing string greater than that required to set said upper packer for unsetting said upper packer.

3. The apparatus of claim 2 further comprising means responsive to a tension in the tubing string greater than that required to unset said upper packer unit for unsetting said lower packet unit to permit withdrawal of the entire tubular assembly.

4. apparatus for isolating a set of perforations in a well conduit wall comprising, in combination, a tubular assembly insertable by tubing string into the well conduit and carrying axially spaced lower and upper packing units; said lower packing unit being positionable in the well conduit below the perforations and said upper packing unit being thereby located above said perforations; said lower packing unit comprising: a tubular body connected at its upper end to said tubular assembly; a lock support sleeve surrounding a portion of said tubular body; locking means radially shiftably mounted on said lock support sleeve; resilient means urging said locking means radially outwardly to lockingly engage the wall of the well conduit; means on said tubular body responsive to upward movement of said tubular body relative to said lock support sleeve for securing said locking means in said locking engagement with the wall of said well conduit; J-slot and pin means operatively interconnecting said tubular body and said lock support sleeve, whereby in one angular position of the tubing string, said tubular body and said lock support sleeve are locked together for co-movement in an axial direction, and in another angular position of the tubing string, said tubular body is axially movable relative to said lock support sleeve; a radially expandable, first annular packing element surrounding said tubular body below said lock support sleeve; a first annular abutment secured to said tubular body below said packing element, whereby upward movement of said tubular body after said locking means engage the conduit wall effects a compression of said packing element into sealing engagement between the conduit wall and the lower exterior of said tubular body, thereby setting the lower packing unit; said upper packing unit comprising a hollow mandrel; means on the upper end of said hollow mandrel for securement to a tubing string; a second radially expandable, annular packing element surrounding a portion of said hollow mandrel; said second annular packing element having an annular upper and lower face; a radial external second abutment on said hollow mandrel engagable with said lower face of said second packing element; an abutment sleeve surrounding said hollow mandrel; means for operatively securing said abutment sleeve to said tubular body of said lower packing unit; and means on said abutment sleeve abuttingly engagable with said upper face of said second packing element, whereby continued upward movement of the tubing string after setting of said lower packing unit effects the setting of said upper packing unit to isolate said perforations.

5. The apparatus of claim 4 further comprising first body lock ring means for preventing downward movement of said tubular body relative to said lock support sleeve; and second body lock ring means for preventing downward movement of said hollow mandrel relative to said abutment sleeve, thereby permitting relexation of tension in the tubing string without unsetting said lower or said upper packer units.

6. The apparatus of claim 5 wherein said first annular abutment on said lower packing unit is shearably secured to said tubular body, whereby the application of a predetermined upward force to said tubular body by the tubing string severs said shearable securement and releases the compressive force on said first annnular packing element.

7. The apparatus of claim 5 wherein said hollow mandrel comprises two axially abutting pieces; and a shearable ring securing said mandrel pieces together, whereby the application of a tensile force to the tubing string greater than that required to set said upper and lower packer units, shears said shearable ring to unset said upper packing unit.

8. The packer of claim 7 wherein said first annular abutment is shearably secured to said tubular body, whereby the application of a predetermined upward force to said tubular body by the tubing string severs said shearable securement and releases the compressive force on said first annular packing element to unset the lower packing unit.

9. A method of isolating a set of perforations in a well conduit with a pair of tension set packing units comprising the steps of:

(1) mounting said packing units in axially spaced relation on a tubing string with the packing elements of the lower packing unit connected to the tubing string by a J-pin and slot mechanism and the packing elements of the upper packing unit connected to the tubing string by shearable means;

(2) inserting the packing units in the well conduit and positioning said packing units in straddling relationship to the set of perforations;

(3) rotating the tubing string to release the J-pin and slot connection for relative axial movement;

(4) elevating the tubing string to apply tension to the lower packing unit to set same and seal the well annulus below the set of perforations; and (5) continuing to elevate the tubing string to apply tension to the upper packing unit to shear said shearable means and permit upward movement of the tubing string relative to the upper packing unit to set same and seal the well annulus above the set of perforations.

10. A method of isolating a plurality of axially spaced sets of perforations in a well conduit by a plurality of tension set packing units comprising the steps of:

(1) mounting said packing units in axially spaced relation on a tubing string corresponding to the spacing of said sets of perforations;

(2) securing the packing element of the lowermost packing unit to the tubing string by a J-pin and slot connection to prevent premature setting of the lowermost packing unit;

(3) securing the packing elements of the upper packing units to the tubing string by a shearable means to prevent premature setting;

(4) inerting the packing units in the well conduit by the tubing string and positioning said packing units respectively intermediate said sets of perforations;

(5) rotating the tubing string to release the J-pin and slot connection of the lowermost packing unit for relative axial movement;

(6) elevating the tubing string to apply tension to the lowermost packing unit to set same and seal the well annulus; and (7) continuing to elevate the tubing string to apply tension to the upper packing units to shear said shearable means and produce upward movement of the tubing string relative to the upper packing units to set same and seal the well annulus at each location of the upper packing units.

11. A method of isolating a set of perforations in a well conduit with a pair of tension set packing units, each unit comprising a body element, a radially expandable packing element surrounding the body element, setting means responsive to a first tension in said body element for expanding said packing element and setting the packing unit and a shearable element in said setting means responsive to a second higher tension in said body element for unsetting the packing unit, the shearable element of the lower packer requiring a higher tension to shear than the shearable element of the upper packing unit; comprising the steps of:

(1) mounting said packing units in axially spaced relation on a tubing string with the packing element of the lower packing unit connected to the tubing string by a J-pin and slot mechanism and the packing element of the upper packing unit connected to the tubing string by shearable means;

(2) inserting the packing units in the well conduit and positioning said packing units in straddling relationship to the set of perforations;

(3) rotating the tubing string to release the J-pin and slot connection for relative axial movement;

(4) elevating the tubing string to apply tension to the lower packing unit to set same and seal the well annulus below the set of perforations;

(5) continuing to elevate the tubing string to apply tension to the upper packing unit to set same and seal the well annulus above the set of perforations;

(6) applying a higher tension to the body of said upper packing unit sufficient to shear said shearable element and unset the upper packer; and (7) applying a still higher tension to the body of said lower packing unit sufficient to shear said shearable element of said lower packing unit to unset same and permit withdrawal of both packing units from the well conduit.

12. Apparatus for isolating a set of perforations in a well conduit having an internal recess below said perforations comprising, in combination, a tubular assembly insertable by a tubing string into the well conduit and carrying axially spaced lower and upper packing units; said lower packing unit being positionable in the well conduit below the perforations and said upper packing unit being thereby located above said perforations; said lower packing unit comprising: a tubular body connected at its upper end to said tubular assembly; a lock support sleeve surrounding a portion of said tubular body; locking means radially shiftably mounted on said lock support sleeve; resilient means urging said locking means radially outwardly to lockingly engage the internal recess of the well conduit; means on said tubular body responsive to upward movement of said tubular body relative to said lock support sleeve for securing said locking means in said locking engagement with the internal recess of said well conduit; J-slot and pin means operatively interconnecting said tubular body and said lock support sleeve, whereby in one angular position of the tubing string, said tubular body and said lock support sleeve are locked together for co-movement in an axial direction and in another angular position of the tubing string, said tubular body is axially movable relative to said support sleeve; a radially expandable, first annular packing element surrounding said tubular body below said lock support sleeve; an annular abutment secured to said tubular body below said packing element, whereby upward movement of said tubular body after said locking dogs enter the conduit internal recess effects a compression of said packing element into sealing engagement between the conduit bore and the lower exterior of said tubular body, thereby setting the lower packing unit; said upper packing unit comprising a tubular outer body having means on its upper end for securement to a tubing string; a second radially expandable annular packing element slidably surrounding a medial portion of said tubular outer body; a radial abutment on the tubular outer body engagable with the bottom end of said second annular packing element; and a body sleeve secured to said tubular assembly and abutting the upper end of said second radially expandable annular packing element, whereby continued upward movement of the tubing string after setting said packing unit effects the setting of said upper packing unit to isolate said perforations.

* * * * *